US009236040B2

(12) United States Patent
Nadolny

(10) Patent No.: US 9,236,040 B2
(45) Date of Patent: Jan. 12, 2016

(54) HANDHELD SOUNDING DEVICE AND METHODS OF USE

(71) Applicant: Kevin John Nadolny, Tokyo (JP)

(72) Inventor: Kevin John Nadolny, Tokyo (JP)

( * ) Notice: Subject to any disclaimer, the term of this patent is extended or adjusted under 35 U.S.C. 154(b) by 0 days.

(21) Appl. No.: 14/511,041

(22) Filed: Oct. 9, 2014

(65) Prior Publication Data

US 2015/0096427 A1 Apr. 9, 2015

Related U.S. Application Data

(60) Provisional application No. 61/888,551, filed on Oct. 9, 2013.

(51) Int. Cl.

| | |
|---|---|
| ***G10D 13/06*** | (2006.01) |
| ***G10K 1/071*** | (2006.01) |
| ***G10K 1/074*** | (2006.01) |

(52) U.S. Cl.

CPC ..... *G10K 1/071* (2013.01); *G10D 13/06* (2013.01); *G10K 1/074* (2013.01)

(58) Field of Classification Search

CPC ..... G10D 13/08; G10D 13/06; G10K 1/074; G10K 1/071

See application file for complete search history.

(56) References Cited

U.S. PATENT DOCUMENTS

| | | | | | |
|---|---|---|---|---|---|
| 303,139 | A | * | 8/1884 | Farnham | 446/204 |
| 635,391 | A | * | 10/1899 | Rodgers | 116/158 |
| 1,258,077 | A | * | 3/1918 | Worcester | 446/26 |
| 1,548,628 | A | * | 8/1925 | Petrie | 446/26 |
| 1,686,233 | A | | 10/1928 | Halliday | |
| 1,798,444 | A | * | 3/1931 | Wood | 116/158 |
| 2,780,954 | A | * | 2/1957 | Bryce | 84/375 |
| 3,027,794 | A | * | 4/1962 | Chute | 84/406 |
| 3,120,213 | A | * | 2/1964 | Mulligan | 116/280 |
| 3,421,761 | A | * | 1/1969 | Grant | 473/61 |
| 3,638,011 | A | | 1/1972 | Bain et al. | |
| 4,278,274 | A | | 7/1981 | Ray | |
| 4,392,325 | A | * | 7/1983 | Woronets | 446/26 |
| 5,307,756 | A | * | 5/1994 | Ichimura et al. | 116/166 |
| 5,638,767 | A | | 6/1997 | Bush | |
| 6,109,490 | A | * | 8/2000 | Caluori | 224/220 |
| 6,112,330 | A | * | 9/2000 | Bryan | 2/160 |
| 6,192,708 | B1 | | 2/2001 | Mitchell | |

(Continued)

FOREIGN PATENT DOCUMENTS

| | | | |
|---|---|---|---|
| CA | 2242263 | A1 | 1/2000 |
| CN | 201784743 | U * | 4/2011 |

(Continued)

*Primary Examiner* — Robert W Horn

(74) *Attorney, Agent, or Firm* — Christie, Parker & Hale, LLP

(57) ABSTRACT

A sounding device of the present invention includes a grip, an actuator adjacent the grip, and a resonator adjacent the actuator. The grip is configured to be worn on one hand of a user. The actuator is configured to strike the resonator, and the resonator is configured to make a sound when struck by the actuator. A method of utilizing the sounding device includes securing the sounding device on a hand of a user by inserting a first finger of the user's hand near the thumb through the grip, and inserting a second finger of the user's hand adjacent the first finger on at least a portion of the grip. The method further includes placing the thumb on the actuator and activating the sounding device by causing the actuator to make contact with the resonator, wherein the resonator is configured to make a sound when contacted by the actuator.

11 Claims, 19 Drawing Sheets

(56) References Cited

U.S. PATENT DOCUMENTS

| | | | | |
|---|---|---|---|---|
| 6,416,379 | B1 * | 7/2002 | Topman | 446/204 |
| 6,529,121 | B2 * | 3/2003 | Bush | 340/326 |
| 6,734,349 | B1 * | 5/2004 | Adams | 84/322 |
| 7,182,039 | B2 * | 2/2007 | Ichimura et al. | 116/167 |
| 7,424,863 | B2 * | 9/2008 | Tsai | 116/148 |
| D621,290 | S * | 8/2010 | Foxcroft | D10/119.3 |
| 8,028,642 | B2 * | 10/2011 | Foxcroft | 116/137 R |
| D654,948 | S * | 2/2012 | Richmond | D17/22 |
| 8,242,342 | B2 * | 8/2012 | Bettinelli | 84/402 |
| 8,822,800 | B1 * | 9/2014 | Richmond | 84/422.4 |
| 2003/0011469 | A1 | 1/2003 | Bush | |
| 2006/0096520 | A1 | 5/2006 | Ichimura et al. | |
| 2012/0148991 | A1 * | 6/2012 | Coutlee | 434/247 |
| 2014/0083826 | A1 * | 3/2014 | Greenberg et al. | 200/61.12 |
| 2015/0096427 | A1 * | 4/2015 | Nadolny | G10K 1/071 84/406 |

FOREIGN PATENT DOCUMENTS

| | | | | |
|---|---|---|---|---|
| CN | 202518398 | U | * | 11/2012 |
| CN | 202641935 | U | * | 1/2013 |
| DE | 202012104819 | U1 | * | 3/2013 |
| EP | 0486085 | A1 | | 5/1992 |
| EP | 1489569 | A1 | | 12/2004 |
| JP | 08034376 | A | * | 2/1996 |
| JP | 08337187 | A | * | 12/1996 |
| JP | 2000219176 | A | * | 8/2000 |
| KR | 2012110260 | A | * | 10/2012 |
| TW | 200824956 | A | * | 6/2008 |
| TW | 380274 | U | * | 5/2010 |
| TW | 411380 | U | * | 9/2011 |
| TW | 455674 | U | * | 6/2013 |

* cited by examiner

HANDHELD SOUNDING DEVICE AND METHODS OF USE

CROSS-REFERENCE TO RELATED APPLICATION

This application claims priority to and the benefit of U.S. Provisional Patent Application No. 61/888,551, filed in the U.S. Patent and Trademark Office on Oct. 9, 2013, the entire content of which is incorporated herein by reference.

BACKGROUND

1. Field

Aspects of the present invention relate to a sounding or warning device and methods of using the same, and more particularly, to a single-hand-operated sounding device configured to be worn and operated on one hand of a user, and related methods of using the same.

2. Description of the Related Art

Bells and other sounding devices generally include a hollow, cup-shaped acoustic resonator that vibrates when struck with a hammer or other striking implement, making a sound. Bells range in size from small, decorative novelty bells, to large bell tower bells ranging up to several meters or yards in height and/or resonator diameter. These types of bells are commonly made of metals, though smaller-sized bells (i.e., dinner bells and novelty bells) also may be made of ceramics or glass.

Traditional handheld bells often include a handle with the resonator at one end and a grip area at the opposite end. The handle is generally made of the same material as the bell resonator, or may also be made of a different material, such as wood. These traditional handheld bells include a striking implement or hammer within the resonator cup, suspended within the bell. The handheld bell sounds by shaking the bell or otherwise causing the striking implement to strike the inside of the resonator cup of the bell with a repeated back-and-forth or up-and-down motion. These traditional handheld bells are often fairly large in size and weight. Moreover, traditional handheld bells are generally designed for infrequent use, and to be set down or otherwise have the striking implement prevented from motion within the bell when not in use (or when causing an alarming sound is undesired).

Bicycle or bike bells are a type of portable sounding device often used by bicycle riders to alert others of their presence. These types of bells must be mounted, for example, on bike handles, baskets, or other mountable surfaces for use. The operation and materials of these bells is similar to more traditional bells, including a resonator and a striking implement. Bike bells often include a lever to be wound or pulled causing the striking implement to strike the resonator and cause an alarm or sound. However, use of these bells requires mounting the device to a stable surface such that activating the striking implement does not displace the bell instead.

Bear bells are another type of bell used by some, including hikers or campers, on bear-populated areas such as backcountry trails. These types of bells are often attached to a backpack or other worn accessory and emit a sound as the person hikes or walks. These bear bells continually emit a sound as long as the person continues to move (i.e., walk). Thus, these types of bells tend to be both disruptive and impractical for other uses as they continue to sound as long as the wearer or user is in motion—thus resulting in the bell sound being a constant rather than an alert, and no longer provide an alarming or alerting function once motion ceases.

Runners, hikers, walkers, rollerbladers, skiers, snowboarders, skateboarders, and the like (collectively, "pedestrians") typically share the same sidewalks, boardwalks, trails, streets, slopes, etc., as other such pedestrians, animals, or vehicles. It is often necessary for these pedestrians to alert other pedestrians, animals, or vehicles of their presence, and to warn of any potential dangers of collision, etc. Often, vocal alerts are not possible or are not suitably audible to properly alert other pedestrians. Moreover, a vocal or verbal alert may not be universally understood by all pedestrians, animals, or vehicles. Alternatively, louder, horn-type sounds may be unnecessarily disruptive or misconstrued, possibly causing further confusion or potential danger.

Therefore, there is a need for a warning or alarming device that is mobile, versatile, lightweight, and easily operable for universally alerting others of a pedestrian's presence and approach.

SUMMARY

Aspects of the present invention relate to a sounding or warning device and methods of using the same, and more particularly, to a hand-operated sounding device configured to be worn and operated on one hand of a user, and related methods of using the same. According to additional aspects of the present invention, the sounding device is configured to be used by sounding the device using a single-handed operation by users including runners, hikers, bikers, skiers and snowboarders, walkers, the visually impaired, and the like, for alerting or warning others, including people or animals, of their presence or approach.

According to aspects of the present invention, a sounding device includes a grip, an actuator adjacent the grip, and a resonator adjacent the actuator. The grip may be configured to be worn on one hand of a user. The actuator may be configured to make contact with the resonator, and the resonator may be configured to make a sound when contacted by the actuator.

In an embodiment, the grip may include at least one ring configured to be worn on one finger of the one hand of the user.

In an embodiment, the at least one ring of the grip may include at least one first ring and a second ring portion adjacent to the at least one first ring. The second ring portion may be configured to be supported by a second finger of the one hand of the user.

In an embodiment, the second ring portion may include a full second ring. The at least one first ring of the grip may be configured to be worn on the forefinger, and the full second ring may be configured to be worn on the middle finger of the one hand of the user.

In an embodiment, the sounding device may further include a shaft, the shaft being coupled at a bottom of the shaft to the grip and extending up from the grip in a direction substantially perpendicular to a direction in which the first and second fingers of the one hand of the user may be configured to support the grip. The actuator may be coupled to the shaft in a direction substantially perpendicular to the shaft. The resonator may be coupled to the shaft at a top of the shaft, such that the grip may be coupled to the shaft at a bottom of the shaft, the actuator may be between the grip and the resonator, and the resonator may be at a top of the shaft.

In an embodiment, the sounding device may further include a shaft, the shaft being coupled at a bottom of the shaft to the grip and extending up from the grip in a direction substantially perpendicular to a direction in which the first and second fingers of the one hand of the user may be configured to support the grip. The actuator may be coupled to the shaft in a direction substantially parallel to the shaft. The resonator may be coupled to the shaft at a top of the shaft, such that the grip may be coupled to the shaft at a bottom of the shaft, the actuator may extend out from between the grip and the resonator, and the resonator may be at a top of the shaft.

In an embodiment, the actuator and the resonator may be coupled to the grip of the sounding device at the at least one first ring. The resonator may be centered on the at least one first ring and may be configured to be worn on a forefinger of a user. The actuator may extend up from a side of the at least one first ring at a location approximately 90 degrees from where the resonator is coupled to the at least one first ring. The actuator may be configured to be accessible by a thumb of the user's hand for activating the sounding device.

In an embodiment, the at least one ring may include at least two rings. The second ring portion may include a portion of a third ring, wherein the two rings of the grip may be configured to be worn on the forefinger and the middle finger of the one hand of the user, and wherein the portion of the third ring may be configured to be supported on a ring finger of the user's hand.

In an embodiment, the actuator may further include a striking element, a spring coupled to the striking element adjacent a midpoint of the actuator, and a coupling element at a bottom of the actuator that may be configured to couple the actuator to the sounding device. The striking element may be at a top of the actuator and may be configured to make contact with the resonator when activated. The spring may be configured to hinge to allow the striking element to move a distance from its resting position to a position contacting the resonator when activated.

In an embodiment, the actuator may be configured to make contact with the resonator from a side or top of the resonator.

In an embodiment, the actuator may be configured to make contact with the resonator from a bottom and center of the resonator.

In an embodiment, the actuator may further include a wire support, the wire support may extend from the coupling element downward in a u-shape past the grip and back up toward the resonator with the striking element at a top end of the u-shape and the spring may be coupled to the wire support and the coupling element near a midpoint of the actuator.

According to aspects of the present invention, a method of utilizing a sounding device including a grip, an actuator adjacent the grip, and a resonator adjacent the actuator, with the grip having a first ring to be worn on one finger and at least a portion of a second ring to be supported on a second finger of one hand of a user, includes securing the sounding device on the one hand of a user by inserting a first finger of the hand of the user near the thumb through the first ring of the grip, and inserting a second finger of the hand of the user adjacent the first finger on at least the portion of the second ring of the grip. The method may further include placing the thumb on the actuator of the sounding device. The actuator may be configured to make contact with the resonator upon activation by the thumb of the user, and the resonator is configured to make a sound when contacted by the actuator.

In an embodiment, the actuator and the resonator may be coupled to the grip of the sounding device at the first ring of the grip, and the resonator may be centered on the first ring to be worn on the forefinger of the user. The actuator may extend up from a side of the first ring at a location approximately 90 degrees from where the resonator is coupled to first ring.

In an embodiment, the method may further include activating the sounding device by pulling the actuator back with the thumb of the one hand of the user and releasing the actuator to make contact with the resonator.

In an embodiment, the actuator may further include a striking element, a spring coupled to the striking element adjacent a midpoint of the actuator, and a coupling element at a bottom of the actuator that may be configured to couple the actuator to the sounding device. The striking element may be at a top of the actuator and the spring may be at a midpoint of the actuator such that the pulling back the actuator with the thumb may cause the spring to stretch and allow the striking element to bend back a distance and release a distance from its resting position to a position contacting the resonator.

In an embodiment, the actuator may further include a wire support extending from the coupling element downward in a u-shape past the grip and back up toward the resonator. The striking element may be at a top end of the u-shape and the spring may be coupled to the wire support and the coupling element near a midpoint of the actuator.

In an embodiment, the method may further include repeating the tasks of placing the thumb on the actuator of the sounding device and activating the sounding device to create multiple alerts.

According to aspects of the present invention, a sounding device includes a grip having a first ring and a second ring coupled together, an actuator adjacent the grip, the actuator including a striking element, a spring, and a coupling element. The coupling element of the actuator may be coupled to the first ring of the grip, and the spring may be between the striking element and the coupling element. The sounding device may further include a resonator adjacent the grip, the resonator having a diameter equal to an outer diameter of the first ring and being coupled to the first ring at a center of the resonator and the first ring. The grip may be configured to be worn on one hand of a user with the first ring on an index finger and the second ring on a middle finger of the one hand of the user. The grip may further include a removable insert configured to adjust the size of the grip to fit the one hand of the user. The actuator may be configured to make contact with the resonator with the striking element, and the resonator may be configured to make a sound when contacted by the striking element of the actuator.

In an embodiment, the actuator may be configured to be bent at the spring from a first position spaced from the resonator, back to a second position a distance further spaced from the resonator when pulled in such a direction, and to spring forward and make contact with the resonator at a third position when released from the first position.

BRIEF DESCRIPTION OF THE DRAWINGS

These and other features and advantages of embodiments of the present invention will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
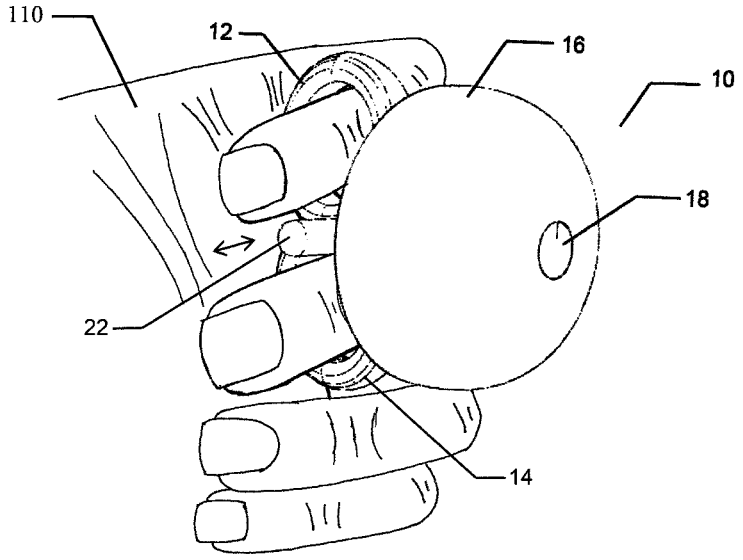
FIG. 1 is a perspective view of a handheld sounding device illustrating its operation according to an embodiment of the present invention.

The detailed description set forth below in connection with the accompanying drawings is intended as a description of embodiments of a handheld sounding device, and related methods, as provided in accordance with the present invention, and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like reference numerals are intended to indicate like elements or features. Moreover, the sizes of the layers and regions in the drawings may be exaggerated for convenience of explanation.

Figure 7:
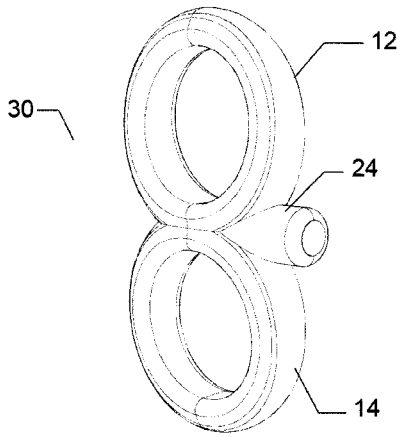
FIG. 7 is a perspective view of a grip of a sounding device according to an embodiment.
Figure 8:
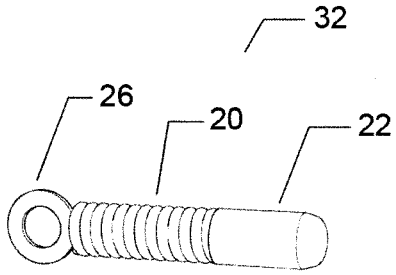
FIG. 8 is a perspective view of an actuator of a sounding device according to an embodiment.
Figure 9:
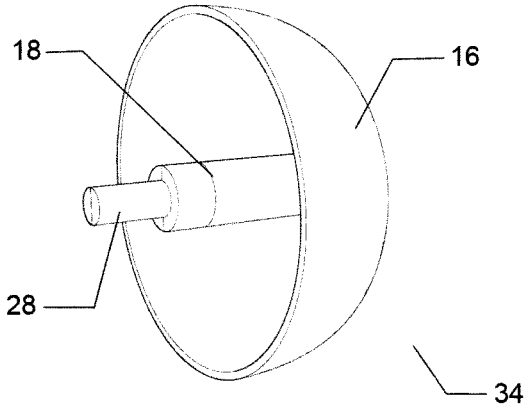
FIG. 9 is a perspective view of a resonator of a sounding device according to an embodiment.

With reference to FIGS. 1-6, a handheld sounding device according to an embodiment of the present invention is shown. With additional reference to FIGS. 7-9, perspective views of a grip, an actuator, and a resonator, respectively, of sounding devices according to embodiments of the present invention are shown. The handheld bell device (hereinafter used interchangeably with "bell," "bell device," "handheld bell," and/or "finger-operated bell") 10, according to this embodiment, includes a grip or grip component (hereinafter used interchangeably) 30 (as shown in FIG. 7), an actuator or actuator component (also referred to interchangeably as a "striking implement," "hammer," and/or "striker") 32 (as shown in FIG. 8), and a resonator or resonator component (hereinafter used interchangeably) 34 (as shown in FIG. 9). The handheld bell device 10, according to this embodiment, is configured to be worn on a single hand 100 of a user (i.e., either the left hand or the right hand of the user), as shown in FIG. 1, for example. In an embodiment, at least two fingers other than the thumb of the user's hand 100 may be engaged to support, wear, or "hold" the bell device 10. In an embodiment, as shown in FIG. 1 for example, the forefinger (or index finger) and middle finger of the user's hand 100 may be inserted through the grip 30 of the bell device 10 to secure the bell device 10 for use.

Figure 2:
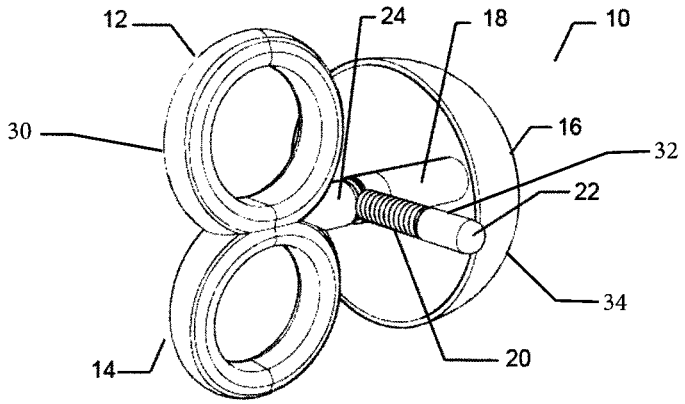
FIG. 2 is a perspective bottom view of the handheld sounding device of FIG. 1.
Figure 21:
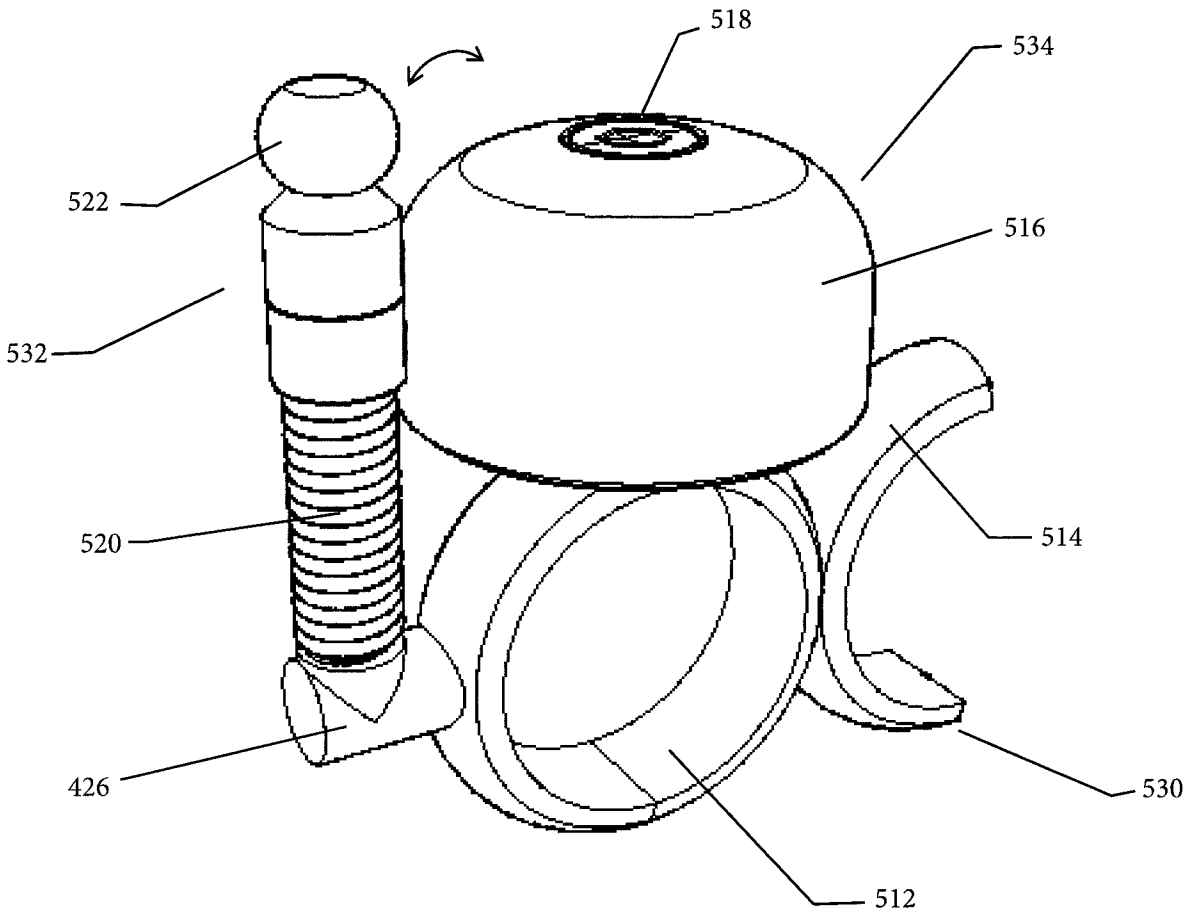
FIG. 21 a perspective view of a handheld sounding device according to another embodiment of the present invention.

As shown in further detail in FIGS. 1, 2; 6, and 7, the grip 30 of the bell device 10 may include at least one ring 12 or 14. In one embodiment, the grip 30 comprises two rings, a first ring 12 and a second ring 14, each configured for insertion of a finger of the user's hand 100 (for example, as shown in FIG. 1) through the rings 12 and 14 for securing the handheld bell 10. In this embodiment, the two rings 12 and 14 of the grip 30 are adjacent to each other. In some embodiments, the two rings 12 and 14 of the grip 30 are coupled, for example, by welding, bonding, integral forming, or other means of coupling the rings 12 and 14 as known and recognized by those skilled in the art. In another embodiment, a grip 530 of the bell device 510 (for example, as shown in FIG. 21) may comprise one full first ring 512 and a second portion of a ring 514 configured to be supported by the fingers of a user's hand 100. Additional details about this embodiment are described in further detail below, with reference to FIGS. 21-23. In the embodiment shown in FIG. 1, for example, the grip 30 is configured such that a forefinger (e.g., index finger) of the user's hand 100 may be inserted through first ring 12, and a middle finger of the user's hand 100 may be inserted through the second ring 14, leaving the thumb free to operate the actuator 32 of the bell device 10. In additional embodiments of the present invention, the bell device 10 may include a plurality of rings 12 and 14. A plurality, as used herein, means more than two. The bell device 10, in this embodiment, is configured to rest securely on and be supported by the fingers of the user's hand 100 such that the bell device 10 is prevented from rotating around the fingers or substantially moving around from its final position for use, once secured on the hand 100. In embodiments of the present invention, the bell device 10 is configured to rest on or adjacent the middle phalanx of the fingers. In other embodiments, the bell device 10 may rest or be supported on other portions of the fingers, including between the main knuckles and the proximal phalanx, or at the distal phalanx of the fingers of the hand 100.

Figure 12:
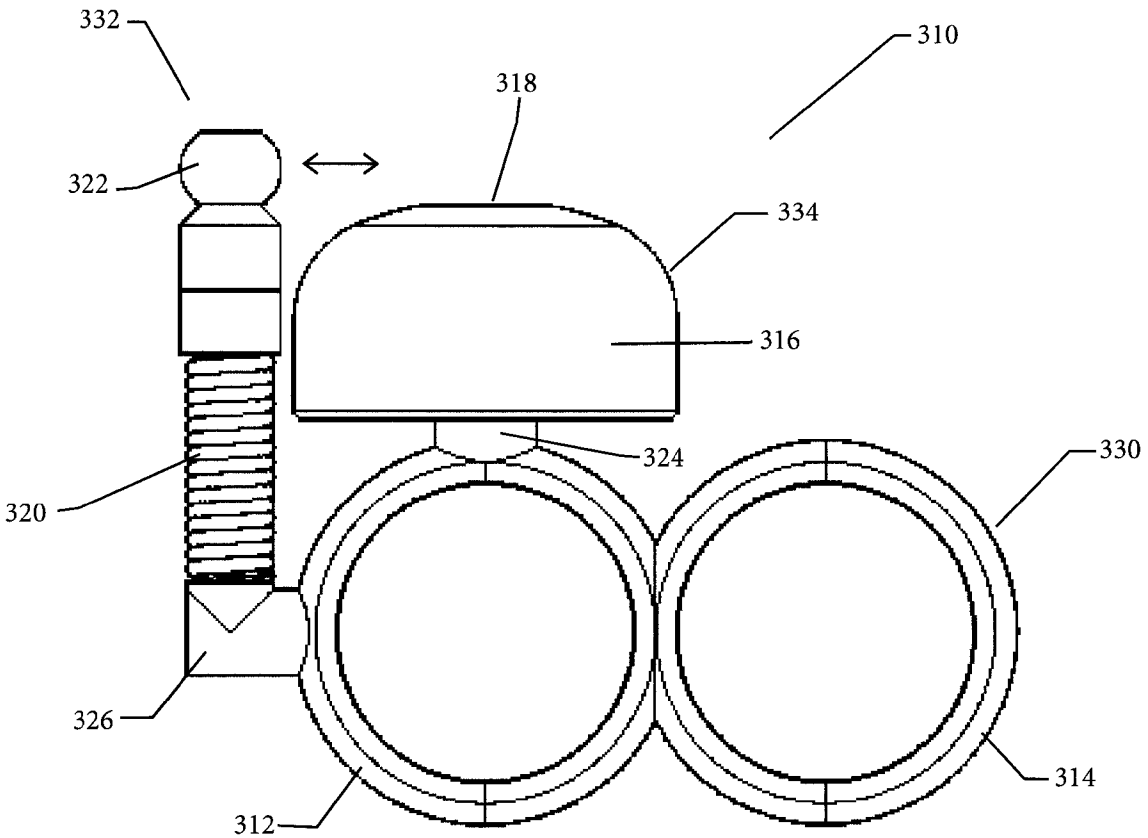
FIG. 12 is a side profile view of a handheld sounding device according to another embodiment of the present invention.
Figure 16:
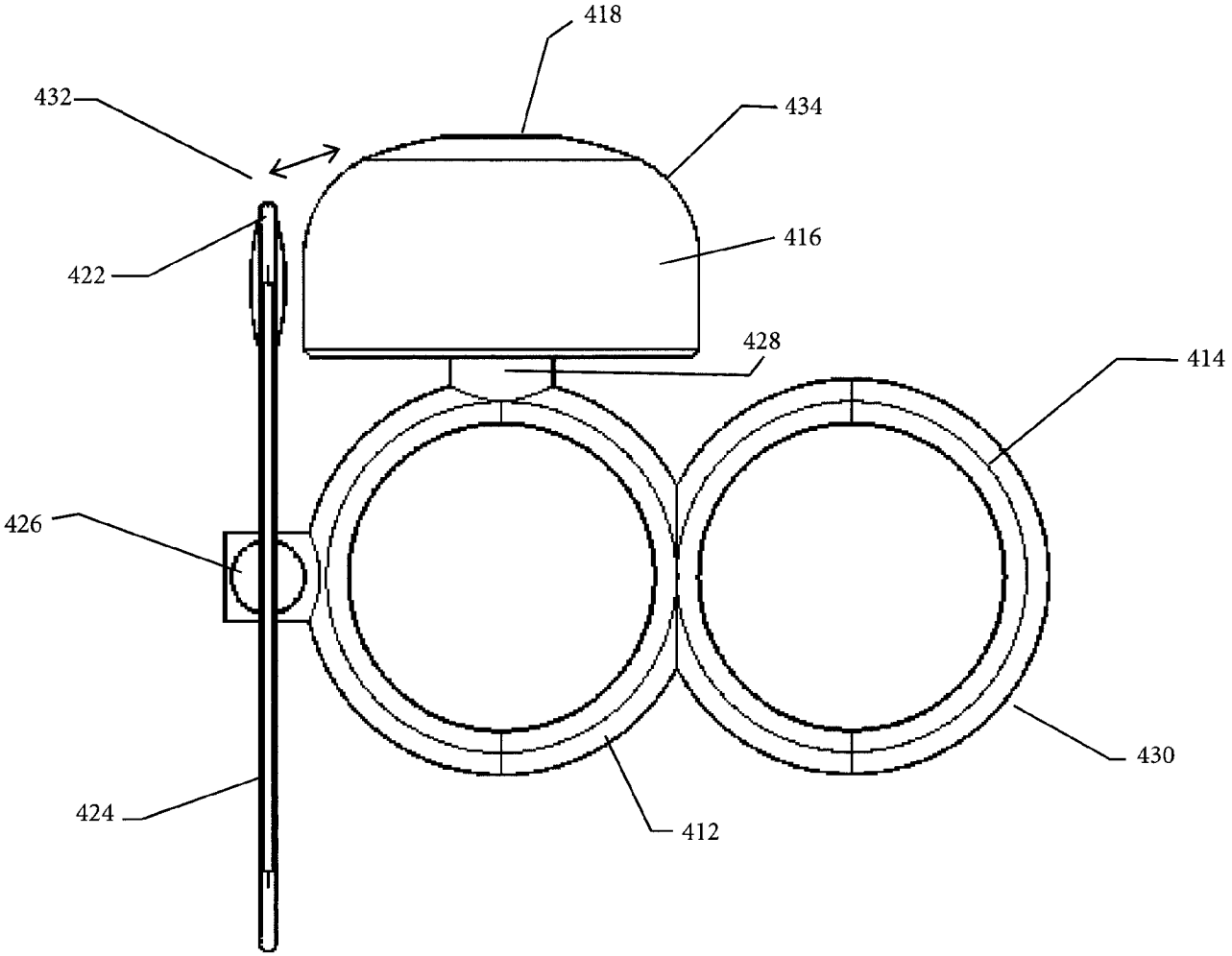
FIG. 16 is a side profile view of a handheld sounding device according to another embodiment of the present invention.
Figure 17:
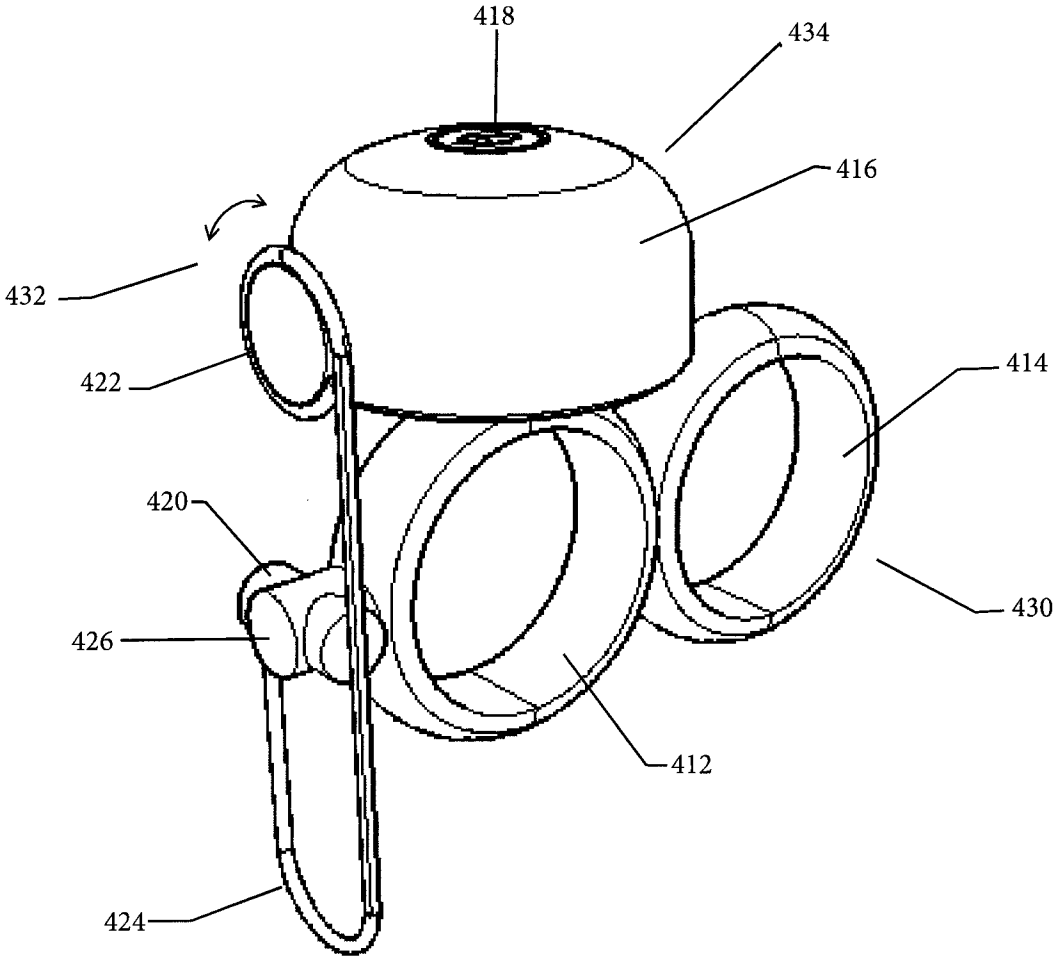
FIG. 17 is a perspective view of the handheld sounding device of FIG. 16.
Figure 18:
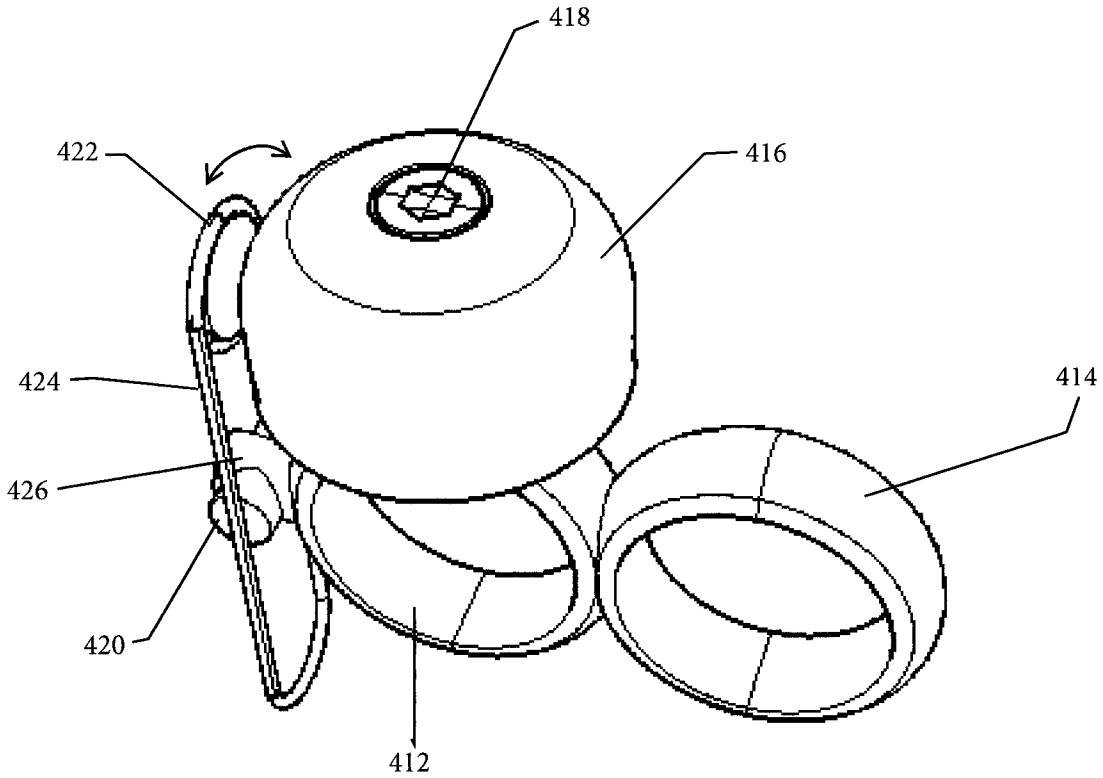
FIG. 18 is a perspective view showing an actuator of the handheld sounding device of FIG. 16.

With continued reference to the embodiments shown in FIGS. 2, 3, 6, and 7, the grip 30 may further comprise a shaft 24 (also referred to as a "first shaft"). The shaft 24, in an embodiment, may be coupled to the first ring 12 and the second ring 14. For example, in an embodiment, as shown in FIG. 2, the shaft 24 may be coupled to the first ring 12 and the second ring 14 at a center between the two rings 12 and 14. In this embodiment, the shaft 24 extends in a direction substantially perpendicular to the direction in which the fingers of a user's hand 100 may be inserted through the grip 30 (i.e., a direction substantially perpendicular to a direction of insertion or hollow opening through the rings 12 and 14). In other embodiments, the shaft 24 (or 324, 424, and/or 524, for example) may extend from one of the rings 12 or 14 (or 312 or 314, 412 or 414, and/or 512 or 514), and may be centered or offset (for example, as shown in FIGS. 12, 16, and 21).

Figure 24A:
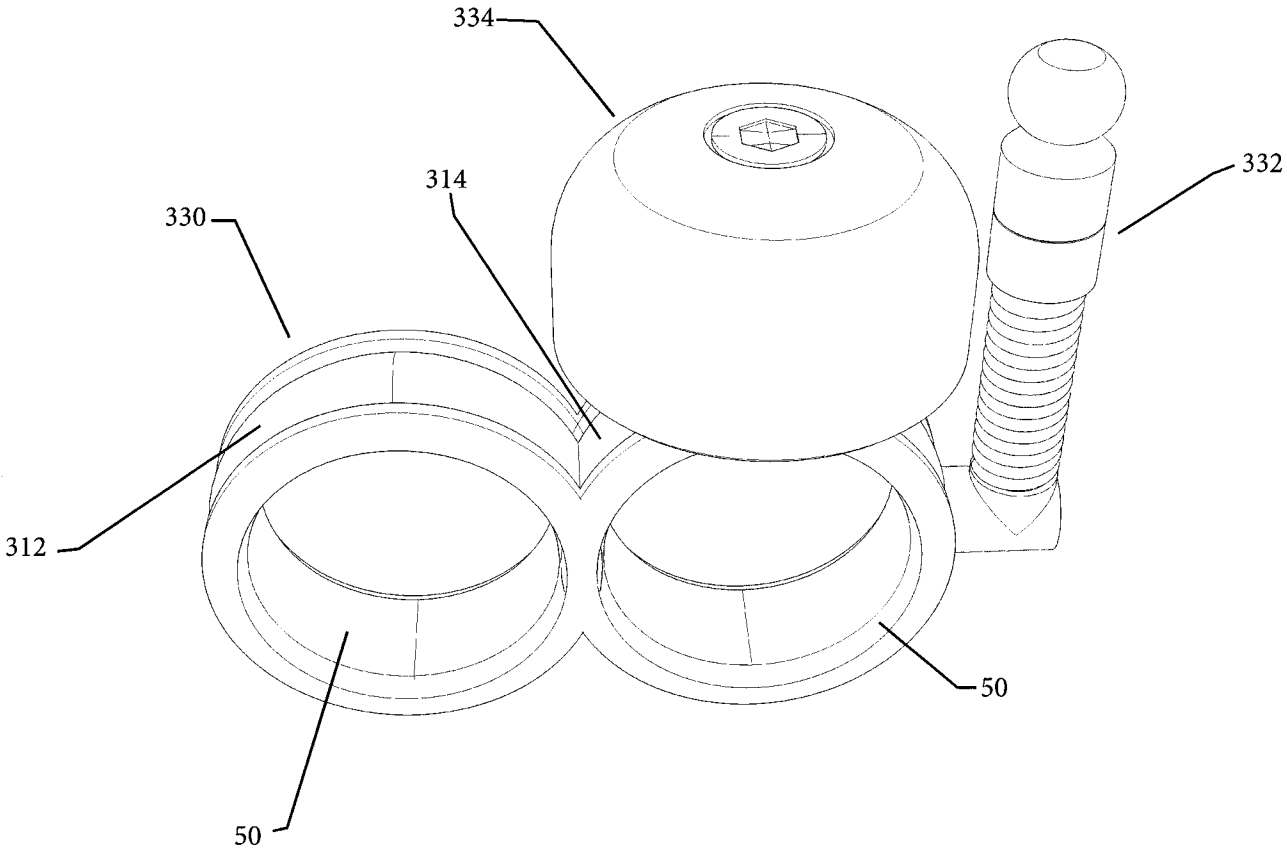
FIG. 24A is a perspective view of a handheld sounding device according to another embodiment of the present showing inserts.
Figure 24B:
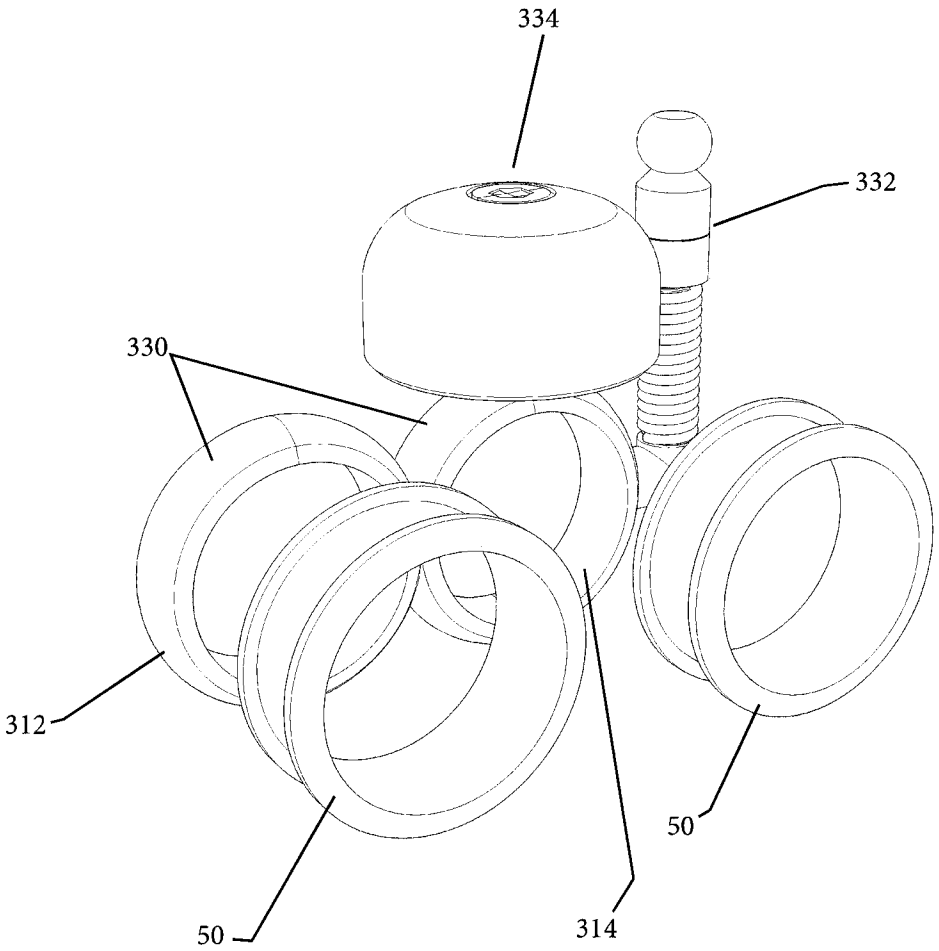
FIG. 24B is an exploded perspective view of the handheld sounding device and inserts of FIG. 24A.

With continued reference to the embodiments shown in FIGS. 2, 3, 6, and 7, and with reference to the embodiments shown in FIGS. 10, 11, 12, 16, 21, 24A, and 24B each of the rings 12, 14 (112, 114, 212, 214, 312, and 314) of the handheld bell device 10 (110, 210, 310, 410, and 510) is sufficiently large and sized to accommodate the fingers of the average or typical user's hand 100. For example, in an embodiment, each of the rings 12, 14 (for example) may have an inner diameter ranging from approximately ¾ inch to approximately 1 inch. In one embodiment, each of the rings 12, 14 has an inner diameter of approximately 21 millimeters (mm). In another embodiment, each of the rings 12, 14 has an inner diameter of approximately 24 millimeters (mm). In other embodiments, the bell device 10 (110, 210, 310, 410, and 510) may come in multiple sizes with rings 12, 14 (etc.) having a range of sizes. In some embodiments, the size of the inner diameter of the grip 30 may be adjustable. In another embodiment, the size of the inner diameter of each of the rings 12, 14 of the grip 30 may be adjustable using an insert 50, as shown in FIGS. 24A and 24B. The insert 50, according to this embodiment, may be inserted into any of the rings 12, 14, for example, in order to adjust the inner diameter of the ring 12, 14 to a smaller size for a better fit to the user's hand 100. The insert 50 may be made of a material having elastic properties suitable adjust the thickness of the rings 12, 14 as needed. In an embodiment, the inserts 50 may be made of a material such as silicone. In other embodiments, the inserts 50 may be made of other materials suitable for comfortably adjusting the inner diameter of the rings 12, 14, as known and appreciated by those skilled in the art. In an embodiment, each of the rings 12, 14 (112, 114, 212, 214, 312, and 314) of the handheld bell device 10 (110, 210, 310, 410, and 510) may have a thickness sufficient to prevent bending or deformation of the handheld bell device 10 during use and wear. In an embodiment, a thickness of the rings 12, 14 (etc.) may range from approximately 1/16 inch to approximately ½ inch or from approximately 1.5 mm to approximately 12 mm. In one embodiment, each of the rings 12, 14 has a thickness less than or equal to 3 mm or ⅛ inch.

Figure 10:
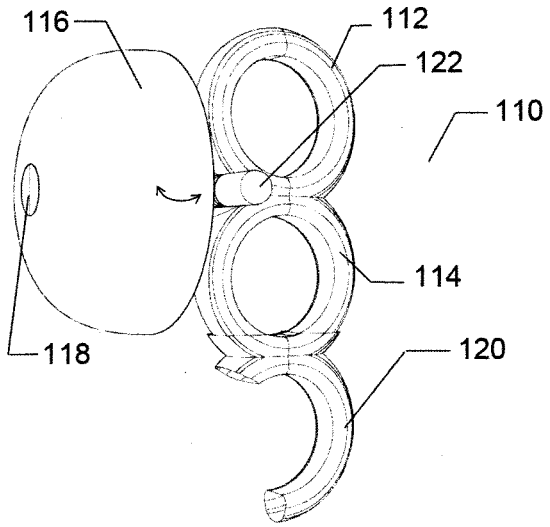
FIG. 10 is a perspective view of a handheld sounding device according to another embodiment of the present invention.

With continued reference to the embodiments shown in FIGS. 1, 2, 3, and 9, the resonator 34 may further comprise a shaft 18 (also referred to as a "second shaft"), a hollow, dome-shaped acoustic resonating component 16, and a coupling pin 28. The resonator 34, in these embodiments, is the part of the bell device 10 configured to sound, alarm, or ring when activated. The bell device 10, according to these embodiments, may be activated by striking the resonator 34 with the actuator 32, as described in further detail below. The resonator 34, according to an embodiment, is coupled to the grip 30 via the second shaft 18. In this embodiment, the second shaft 18 comprises the coupling pin 28 which is configured to be coupled to the first shaft 24 of the grip 30. In an embodiment, the coupling pin 28 may comprise a male insert and the first shaft 24 may comprise a female lock component configured to receive and lock the male insert of the coupling pin 28, coupling the first shaft 24 to the second shaft 18. In another embodiment, the first shaft 24 and/or the second shaft 18 may be threaded such that the two shafts 18 and 24 are coupled together by screwing the threaded shafts 18 or 24 into the threaded receiving shaft 24 or 18. In an embodiment, the coupling pin 28 may be threaded and the first shaft 24 may define a complementary threaded opening configured to receive and lock with the coupling pin 28. In an embodiment, the second shaft 18 and the coupling pin 28 are coupled to the resonating component 16 of the resonator 34 at or through a center of an interior of the resonating component 16 from a center or apex of the domed or cupped shape of the resonating component 16. In this embodiment, the resonator 34 is configured such that the shaft 18 and coupling pin 28 are not exposed from a top view of the bell device 10 (for example, as shown in FIG. 10). However, the placement of the second shaft 18 and the coupling pin 28 are not limited to these locations, and in other embodiments, may be coupled or formed with the resonating component 16 in a different manner as known and appreciated by those skilled in the art. The resonator 34, according to an embodiment, may be sized and shaped such that it can sound or alert with sufficient volume while remaining mobile, versatile, light, and small enough to carry in or on a user's single hand 100. In an embodiment, the resonating component 16 (116, 216, 316, 416, and 516) of the resonator 34 may range in size from approximately ½ inch to approximately 3 inches in diameter, and may have a thickness ranging in size from approximately 1/64 inch to approximately ¼ inch. In one embodiment, the resonator 34 may have a thickness ranging in size from approximately 0.8 mm to approximately 1.2 mm. In one embodiment, the resonator 34 has a diameter of approximately 27 mm (or 1 inch) and a height measured from the top of the cup or resonator 34 down to its bottom of approximately 12 mm (or ½ inch).

With continued reference to the embodiments shown in FIGS. 1, 2, 3, 5, and 8, the actuator 32 may further comprise a striking implement or hammer 22, a spring 20, and a coupling element 26. The bell device 10, according to these embodiments, may be activated by striking the resonator 34 with the striking implement or hammer 22 of the actuator 32. The actuator 32 is configured to be moveable from an inert or at-rest position to a striking position configured to activate the bell device 10 at the spring 20. The spring 20, in these embodiments, may be configured to act as a joint or hinge to allow the hammer or striking implement 22 of the actuator 32 to be moved a distance to contact, and therefore sound, the resonator 34 of the bell device 10. In an embodiment, the actuator 32 may bend back at least 90 degrees at the spring 20, before being released to contact the resonator 34. The actuator 32, according to an embodiment, may be sized and shaped such that the bell device 10 can sound or alert with sufficient volume when the actuator 32 is activated by contacting or striking against the resonator 34, while remaining mobile, versatile, light, and small enough to activate with the thumb or finger of a user's single hand 100. In an embodiment, the hammer or striking implement 22 (122, 222, 322, 422, and 522) of the actuator 32 may range in size from approximately ⅛ inch to approximately ¾ inch in diameter. In one embodiment, the actuator 32 is approximately 21.5 mm (or ⅞ inch) in total length, with the spring 20 having a length of approximately 15 mm (or 9/16 inch) in total length, with the hammer or striking implement 22 comprising threads configured to couple to the spring 20 of the actuator; in this embodiment, the threads may have a length of approximately 5 mm (3/16). In an embodiment, a thickness or diameter of the actuator 32 is approximately 7 mm (¼ inch). In an embodiment, the spring 20 (220, 320, 420, and 520) of the actuator 32 may be sufficiently flexible to allow a user to pull the spring 20 back with one finger of a single hand 100, while maintaining sufficient rigidity to prevent deformation of it shape and to prevent losing its springing and striking capacity and range.

In an embodiment, the spring 20 (220, 320, 420, and 520) of the actuator 32 may range in size from approximately ⅛ inch to approximately ¾ inch in diameter with a spring or wire thickness ranging from approximately 1/64 inch to ⅛ inch. The spring 20, according to an embodiment, is configured to couple to the hammer or striking implement 22. In on embodiment, the spring 20 and the hammer or striking implement 22 may threaded in a complementary manner for coupling. In another embodiment, the spring 20 and the hammer or striking implement 22 may be welded or otherwise bonded together. In an embodiment, the hammer or striking implement 22 may have a rounded head configured for ease of access by the user's hand as well as for increased impact sound or resonance when striking the resonator 34 in use.

The actuator 32, according to an embodiment, is coupled to the bell device 10 via the spring 20 and the coupling element 26. The coupling element 26, in an embodiment, comprises a round washer or ring configured to couple to the first shaft 24 and/or the second shaft 18 of the bell device 10. In this embodiment, the coupling element 26 may comprise threads for coupling or locking the actuator 32 to the bell device 10. In an embodiment, for example, as shown in FIGS. 1-6, the actuator 32 may be coupled to the bell device 10 via the grip 30 and the resonator 34, such that the coupling element 26 of the actuator 32 is coupled to the first shaft 24 of the grip and to the second shaft 18 of the resonator 34 via the coupling pin 28. In this embodiment, the actuator 32 is between the grip 30 and the resonator 34 with the actuator 32 extending in a direction substantially perpendicular to the of extension of the first shaft 24 and substantially parallel to the direction in which the fingers of a user's hand 100 may be inserted through the grip 30. In the embodiment shown in FIGS. 1-6, the actuator 32 comprises the spring between the hammer or striking implement 22 and the coupling element 26 such that when assembled, the hammer or striking implement 22 is configured extend out from the bell device 10 such that it can be activated by a user during use. In this embodiment, the hammer or striking implement 22 of the actuator 32 may extend from between the first ring 12 and the second ring 14 of the grip 30 such that the actuator 32 may be moved and caused to vibrate and strike the resonator 34 with a finger (i.e., the thumb) of a user's hand 100, activating the bell device 10 to sound or ring. The first shaft 24 and the second shaft 18 of the bell device 10, according to an embodiment, may be sized and shaped to sufficiently couple the grip 30, the resonator 34, and the actuator 32 while maintaining a size that is mobile, versatile, light, and small. In an embodiment, the first shaft 24 and the second shaft 18 of the bell device 10 (110, 210, 310, 410, and 510) may range in size from approximately ⅛ inch to approximately ¾ inch in diameter. In an embodiment, the spring 20 (220, 320, 420, and 520) of the actuator 32 may be sufficiently flexible to allow a user to pull the spring 20 back with one finger of a single hand 100, while maintaining sufficient rigidity to prevent deformation of it shape and to prevent losing its springing and striking capacity and range.

The handheld bell device 10, according to embodiments of the present invention, may be made of any material suitable and known in the art. In an embodiment, the handheld bell device 10 may be made of a metal or metallic material, in other embodiments, the handheld bell device 10 may be made of any other sufficiently rigid and strong materials, including, for example, high-strength plastics, and other similar and suitable materials known in the art. Moreover, the various components of the handheld bell device 10 may be made of various or varying materials. In an embodiment, the resonating component 16 of the resonator 34 may be made of a material including copper, brass, aluminum, and/or any other sufficiently rigid and strong material configured to sound or alert when struck by a striking implement, for example, the actuator 32.

With reference now to the embodiment shown in FIG. 10, and with continued reference to the embodiments shown in FIGS. 7-9, a handheld sounding device according to another embodiment of the present invention is shown. Like elements are numbered with like reference numerals (e.g., the resonating component 16 shown in FIGS. 1-6 is referred to as the resonating component 116 in FIG. 10, etc.). Repeat descriptions of elements or components in FIG. 10 that are substantially similar to those shown or described with reference to the embodiments in FIGS. 1-9 have been omitted. The handheld bell device (hereinafter used interchangeably with "bell," "bell device," "handheld bell," and/or "finger-operated bell") 110, according to this embodiment, includes a grip or grip component 30 (as shown in FIG. 7), an actuator or actuator component 32 (as shown in FIG. 8), and a resonator or resonator component (hereinafter used interchangeably) 34 (as shown in FIG. 9). The handheld bell device 110, according to this embodiment, is substantially similar to the handheld bell device 10 described with reference to FIGS. 1-6 above, except for the elements of the grip 30, described in further detail below.

With continued reference to FIG. 10, the grip 30 (e.g., as shown in FIG. 7) of the bell device 110 may include at least two rings 112 and 114. In one embodiment, as shown in FIG. 10, the grip 30 comprises two rings, a first ring 112 and a second ring 114, and at least a portion of a third ring 120, with each of the first and second rings 112 and 114 configured for insertion of a finger of the user's hand 100 (for example, as shown in FIGS. 1, 12, and 16) through the rings 112 and 114, and the portion of the third ring 120 configured to rest on a third finger (i.e., ring finger) of the user's hand 100 to additionally secure the bell device 110. The portion of the third ring 120, according to an embodiment, may be a half ring. In other embodiments, the portion of the third ring 120 may be greater than or less than half of a ring.

In this embodiment, the two rings 112 and 114 and the portion of the third ring are adjacent to each other. In some embodiments, the two rings 112 and 114 and the portion of the third ring 120 are coupled, for example, by welding, bonding, integral forming, or other means of coupling the rings 112, 114, and 120, as known and recognized by those skilled in the art. In the embodiment shown in FIG. 10, for example, the grip 30 is configured such that a forefinger (or index finger) of the user's hand 100 may be inserted through first ring 112, a middle finger of the user's hand 100 may be inserted through the second ring 114, and the portion of the third ring 120 rests on the ring finger of the user's hand 100, leaving the thumb free to operate the actuator 32 of the bell device 110. The bell device 110, in this embodiment, is configured to rest securely on and be supported by the fingers of the user's hand 100 such that the bell device 110 is prevented from rotating around the fingers or substantially moving around from its final position for use once secured on the hand 100. In embodiments of the present invention, the bell device 110 is configured to rest on or adjacent the middle phalanx of the fingers. In other embodiments, the bell device 110 may rest or be supported on other portions of the fingers, including between the main knuckles and the proximal phalanx, or at the distal phalanx of the fingers of the hand 100.

With continued reference to the embodiment shown in FIG. 10, the resonator 34 further comprises a shaft 118 (hereinafter also referred to as a "second shaft") and a hollow, dome-shaped acoustic resonating component 116, substantially similar to the second shaft 18 and resonating component 16 described above with reference to FIGS. 1-6. With continued reference to the embodiment shown in FIG. 10, the actuator 32 of the bell device 110 may further comprise a striking implement or hammer 122, a spring 20, and a coupling element 26, substantially similar to the striking implement or hammer 22, spring 20, and coupling element 26 described above with reference to FIGS. 1-6. Repeat descriptions have been omitted herein.

The materials, sizes, and thickness of the grip 30 and additional components of the handheld bell 110 according to this embodiment are the same or similar to those described with reference to the handheld bell 10, described above, and will not be repeated herein.

Figure 11:
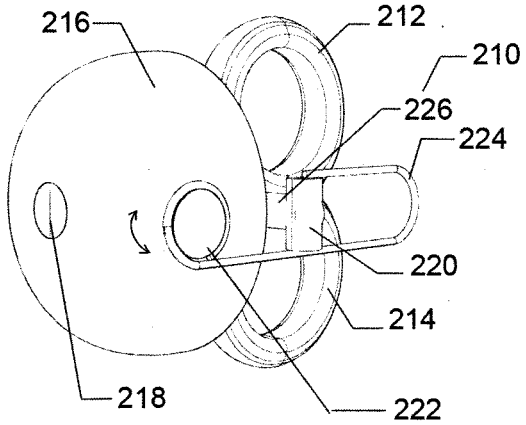
FIG. 11 is a perspective view of a handheld sounding device according to another embodiment of the present invention.

With reference now to the embodiment shown in FIG. 11, and with continued reference to the embodiments shown in FIGS. 7-9, a handheld sounding device according to another embodiment of the present invention is shown. Like elements are numbered with like reference numerals (e.g., the resonating component 16 shown in FIGS. 1-6 is referred to as the resonating component 216 in FIG. 11, etc.). Repeat descriptions of elements or components in FIG. 11 that are substantially similar to those shown or described with reference to the embodiments in FIGS. 1-9 have been omitted. The handheld bell device (hereinafter used interchangeably with "bell," "bell device," "handheld bell," and/or "finger-operated bell") 210, according to this embodiment, includes a grip or grip component 30 (as shown in FIG. 7), an actuator or actuator component 32 (as shown in FIG. 8), and a resonator or resonator component (hereinafter used interchangeably) 34 (as shown in FIG. 9). The handheld bell device 210, in this embodiment, is substantially similar to the handheld bell device 10 described with reference to FIGS. 1-6 above, except for the elements of the actuator 32, described in further detail below.

With continued reference to FIG. 11, the grip 30 (e.g., as shown in FIG. 7) of the bell device 210 may include at least two rings 212 and 214, substantially similar to the at least two rings 12 and 14 described with regards to the embodiment shown in FIGS. 1-9. Accordingly, repeat descriptions are omitted herein.

With continued reference to the embodiments shown in FIG. 11, the resonator 34 may further comprise a shaft 218 (hereinafter also referred to as a "second shaft"), a hollow, dome-shaped acoustic resonating component 216, and a coupling pin 28, substantially similar to the second shaft 18, resonating component 216, and coupling pin 28, described previously with respect to the embodiments shown in FIGS. 1-9. The bell device 210, according to this embodiment, may be activated by striking the resonator 34 with the actuator 32, as described in further detail below.

With continued reference to the embodiment shown in FIG. 11, the actuator 32 may further comprise a striking implement or hammer 222, a spring 220, a wire support 224, and a shaft 226 (hereinafter referred to as a "third shaft"). The bell device 210, according to this embodiment, may be activated by striking the resonator 34 with the striking implement or hammer 222 of the actuator 32. The actuator 32 is configured to be moveable from an inert or at-rest position to a striking position configured to activate the bell device 210 at the spring 220. The spring 220, in these embodiments, may be configured to act as a joint or hinge to allow the hammer or striking implement 222 of the actuator 32 to be moved over a distance to sound the resonator 34 of the bell device 210. The actuator hammer or striking implement 222 of the actuator 32, according to this embodiment, is coupled to the wire support 224, and is configured to be activated with a finger (i.e., the thumb) of the user's hand 100. In this embodiment, the wire support 224 is coupled to the spring 220 which is coupled to the third shaft 226. The third shaft 226 according to this embodiment is coupled to the grip 30 where the second shaft 218 is coupled to the grip 30, with the wire support 224 extending from the third shaft 226 in a U-shape or elliptical shape in a direction substantially perpendicular to the direction in which the fingers of a user's hand 100 may be inserted through the grip 30.

The actuator 32, according to this embodiment, is coupled to the bell device 10 via the spring 220 and the third shaft 226. The third shaft 226, in an embodiment, comprises a t-shaped extension configured to couple to the grip 30 and/or the second shaft 218 of the bell device 210. In an embodiment, for example, as shown in FIGS. 1-6, the actuator 32 may be coupled to the bell device 210 via the grip 30 and the resonator 34, such that the third shaft 226 of the actuator 32 is coupled to the second shaft 218 of the resonator 34 via the wire support 224. In this embodiment, the actuator 32 is between the grip 30 and the resonator 34 with the actuator 32 extending in a direction substantially perpendicular to the direction in which the fingers of a user's hand 100 may be inserted through the grip 30. In the embodiment shown in FIG. 11, the actuator 32 comprises the spring 220 between the hammer or striking implement 222 and the third shaft 226 connected via the wire support 224 such that, when assembled, the hammer or striking implement 222 is configured to extend out from the bell device 210 so it can be activated by a user during use. In this embodiment, the hammer or striking implement 222 of the actuator 32 may extend from between the first ring 212 and the second ring 214 of the grip 30 such that the actuator 32 may be moved and caused to vibrate and strike the resonator 34 with a finger (i.e., the thumb) of a user's hand 100, activating the bell device 210 to sound or ring.

The materials, sizes, and thickness of the grip 30 and additional components of the handheld bell 210 according to this embodiment are the same or similar to those described with reference to the handheld bell 10, described above, and will not be repeated herein.

With reference to FIGS. 12-15, a handheld sounding device according to another embodiment of the present invention is shown. The handheld bell device (used interchangeably with "bell," "bell device," "handheld bell," and/or "finger-operated bell") 310, according to this embodiment, includes a grip or grip component 330 (similar to that shown in FIG. 7), an actuator or actuator component (used interchangeably with "striker") 332 (similar to that shown in FIG. 8), and a resonator or resonator component (used interchangeably) 334 (similar to that shown in FIG. 9). The handheld bell device 310, according to this embodiment, is configured to be worn on a single hand 100 of a user (i.e., either the left hand or the right hand of the user). In an embodiment, at least two fingers other than the thumb of the user's hand 100 may be engaged to support, wear, or "hold" the bell device 310. Similar to the embodiments shown in FIGS. 1-6, as shown in FIG. 1 for example, the forefinger (or index finger) and middle finger of the user's hand 100 may be inserted through the grip 330 of the bell device 310 to secure the bell device 310 for use.

Figure 13:
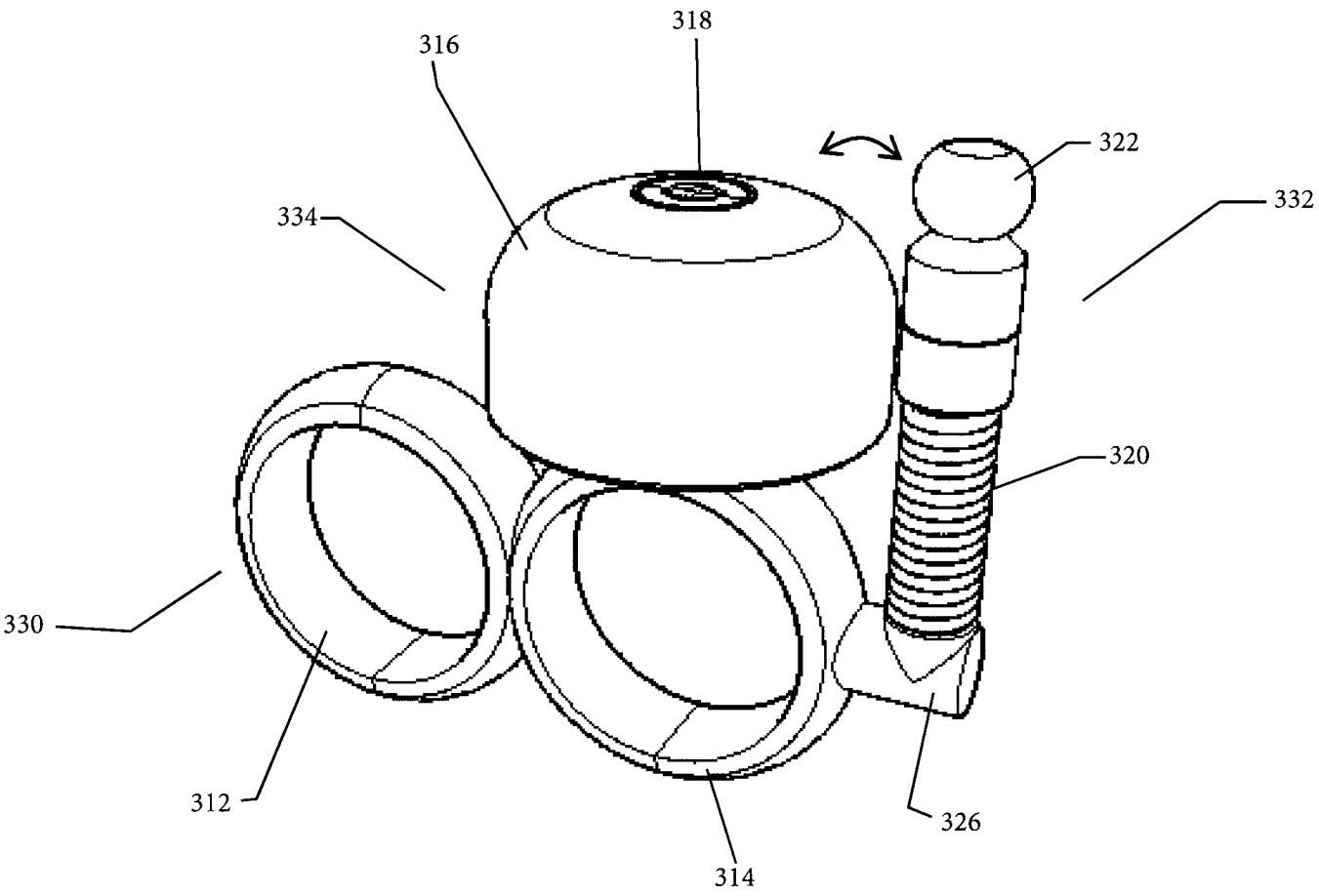
FIG. 13 is a perspective view of the handheld sounding device of FIG. 12 configured for a left-handed user.
Figure 14:
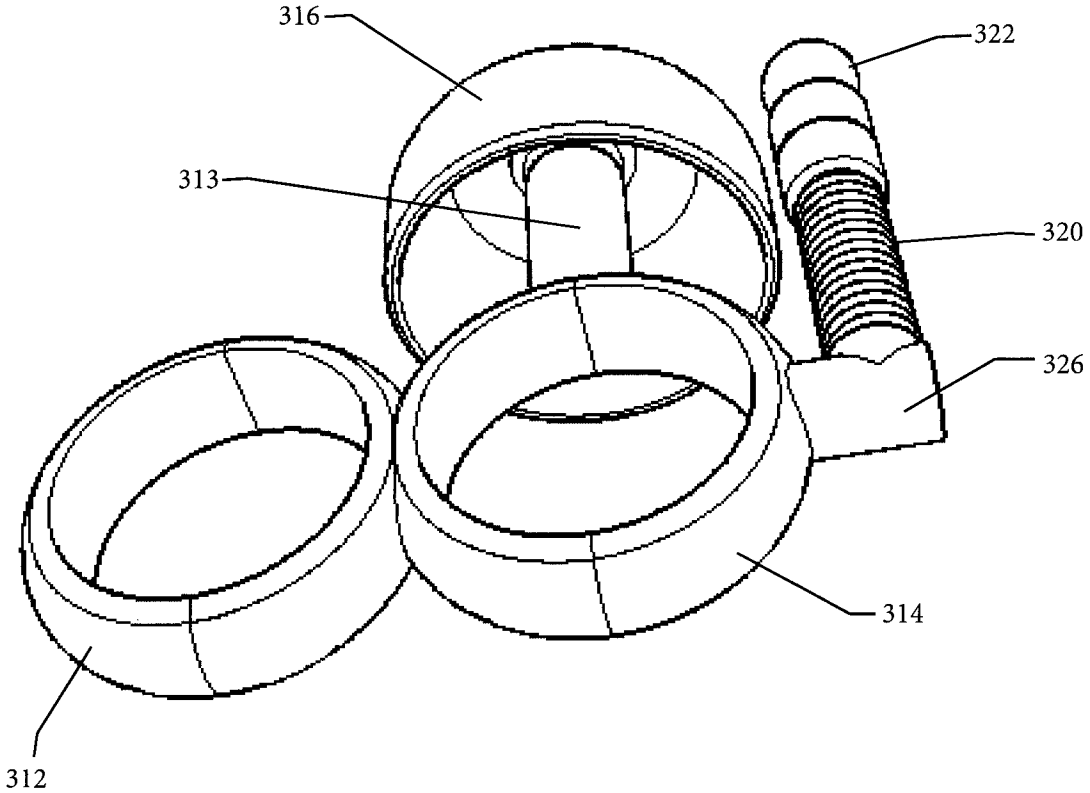
FIG. 14 is a perspective bottom view of the handheld sounding device of FIG. 13.
Figure 15:
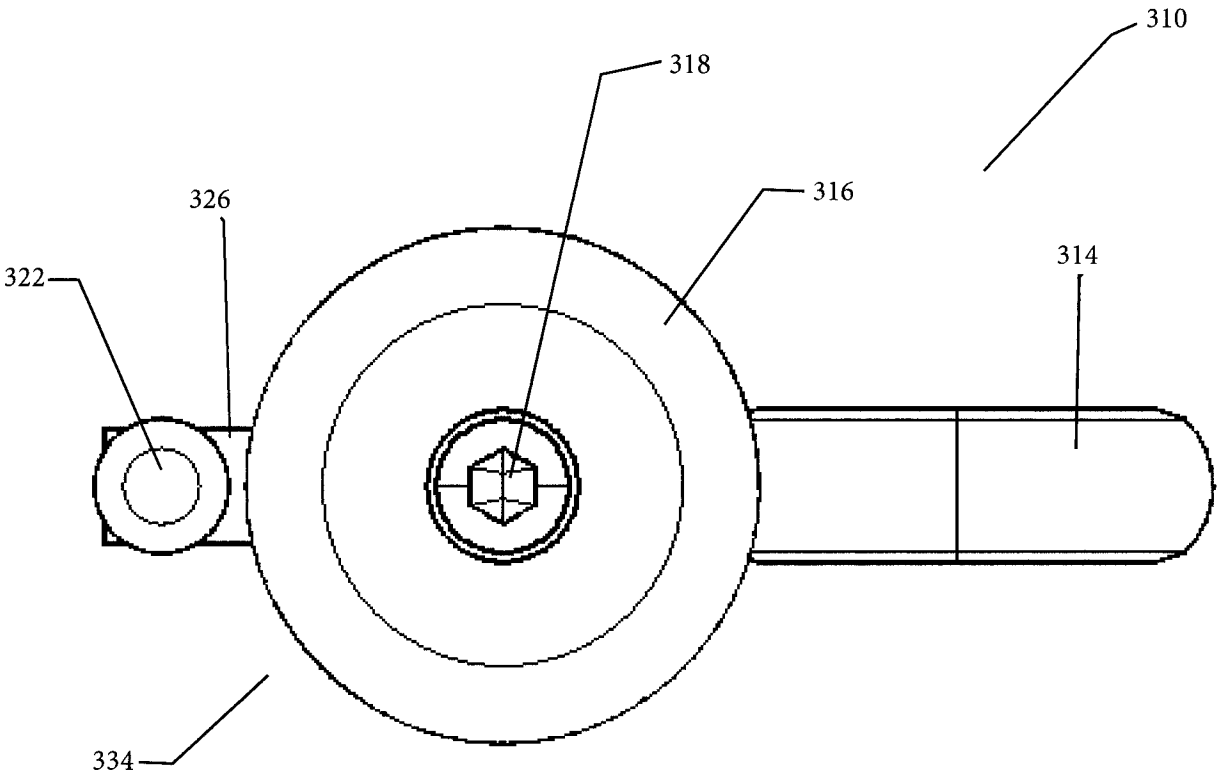
FIG. 15 is a top view of the handheld sounding device of FIG. 12.

As shown in further detail in FIGS. 12-14, the grip 330 of the bell device 310 may include at least one ring 312 or 314. In one embodiment, the grip 330 comprises two rings, a first ring 312 and a second ring 314, each configured for insertion of a finger of the user's hand 100 through the rings 312 and 314 for securing the handheld bell 310. In this embodiment, the two rings 312 and 314 of the grip 330 are adjacent to each other. In these embodiments, the two rings 312 and 314 of the grip 330 are coupled as described above with reference to FIGS. 1-6. In the embodiment shown in FIGS. 12-15 the grip 330 is configured such that a forefinger (or index finger) of the user's hand 100 may be inserted through first ring 312, and a middle finger of the user's hand 100 may be inserted through the second ring 314, leaving the thumb free to operate the actuator 332 of the bell device 310. The bell device 310, in this embodiment, is configured to rest securely on and be supported by the fingers of the user's hand 100 such that the bell device 310 is prevented from rotating around the fingers or substantially moving around from its final position for use once secured on the hand 100. In embodiments of the present invention, the bell device 310 is configured to rest on or adjacent the middle phalanx of the fingers, but may rest or be supported on other portions of the fingers, including between the main knuckles and the proximal phalanx, or at the distal phalanx of the fingers of the hand 100.

With continued reference to the embodiments shown in FIGS. 12-15, the grip 330 may further comprise a shaft 324 (hereinafter also referred to as a "first shaft"). The shaft 324, in an embodiment, may be coupled to the first ring 312 (as shown in FIG. 12, for example) or the second ring 314 (as shown in FIG. 13, for example). In these embodiments, the shaft 324 extends in a direction substantially perpendicular to the direction in which the fingers of a user's hand 100 may be inserted through the grip 330 (i.e., a direction substantially perpendicular to a direction of insertion or hollow opening through the rings 312 and 314). In this embodiment, the shaft 324 extends from one of the rings 312 or 314, and may be centered on the one ring 312 or 314. The size, thickness, diameter, and material of each of the rings 312, 314 of the handheld bell device 310 is sufficiently similar to those described above with reference to the embodiments shown in FIGS. 1-6 and FIGS. 24A and 24B.

With continued reference to the embodiments shown in FIGS. 12-15, the resonator 334 may further comprise a shaft 318 (hereinafter also referred to as a "second shaft") and a hollow, dome-shaped acoustic resonating component 316. The bell device 310, according to this embodiment, may be activated by striking the resonator 334 with the actuator 332, as described in detail above. The resonator 334, according to an embodiment, is coupled to the grip 330 via the second shaft 318. In an embodiment, the second shaft 318 may comprise a coupling pin 28 (for example, as shown in FIG. 9) which is configured to be coupled to the first shaft 324 of the grip 330, as described above with reference to FIGS. 1-9. In an embodiment, the second shaft 318 may be coupled to the resonating component 316 of the resonator 334 at or through a center of an interior of the resonating component 316 from a center or apex of the domed or cupped shape of the resonating component 316. In this embodiment, the resonator 334 is configured such that the shaft 318 is not exposed from a top view of the bell device 310. However, the placement of the second shaft 318 is not limited to this location, and in other embodiments, may be coupled or formed with the resonating component 316 in a different manner as known and appreciated by those skilled in the art. The resonator 334, according to this embodiment, may be sized and shaped as described above with regards to the embodiments shown in FIGS. 1-9. The resonator 334, according to an embodiment, may define an opening at its apex or dome center configured to receive the coupling pin 28 and/or the second shaft 318 from a top of the resonator 334 through to couple to the grip 330. In an embodiment, the opening defined in the apex of the resonator 334 may be configured to receive a coupling pin 28 or shaft 318 having a diameter of approximately 5 mm (or 3/16 inch), and the coupling pin 28 and/or shaft 318 may be a threaded screw or pin having an exterior thread diameter approximately 5 mm (or 3/16 inch) or less. In an embodiment, the opening defined in the apex of the resonator 334 may be configured to receive a coupling pin 28 or shaft 318 having a diameter ranging from approximately 3 mm (or 1/8 inch) to approximately 10 mm (or 3/8 inch), and the coupling pin 28 and/or shaft 318 may be a threaded screw or pin having an exterior thread diameter ranging from approximately 3 mm (or 1/8 inch) to approximately 10 mm (or 3/8 inch). The coupling pin 28 and/or shaft 318, according to these embodiments, may be configured to be inserted from an outside top of the resonator 334 through to the bottom interior and to be coupled to the grip 330 at the first shaft 324. In this embodiment, the coupling pin 28 and/or shaft 318 may be a threaded screw or pin and may be fitted with a washer (e.g., a spring washer) and the grip may be threaded and configured to receive the coupling pin 28 and/or shaft 318 to securely couple the resonator 334 to the grip 330.

With continued reference to the embodiments shown in FIGS. 12-15, the actuator 332 may further comprise a striking implement or hammer 322, a spring 320, and a coupling element 326. The bell device 310, according to these embodiments, may be activated by striking or causing the striking implement or hammer 322 to make contact with the resonator 334 (as indicated by the direction of the arrows in the FIGS., throughout). The actuator 332 is configured to be moveable from an inert or at-rest position to a striking position configured to activate the bell device 310 at the spring 320. The spring 320, in these embodiments, may be configured to act as a joint or hinge to allow the hammer or striking implement 322 of the actuator 332 to be moved over a distance to sound the resonator 334 of the bell device 310. The actuator 332, according to this embodiment, may be sized and shaped as described above with regards to the embodiments shown in FIGS. 1-9.

The actuator 332, according to this embodiment, is coupled to the bell device 310 via the spring 320 and the coupling element 326. The coupling element 326, in this embodiment, may be coupled to the grip 330 of the bell device 310 such that the coupling element 326 of the actuator 332 is coupled to either the first ring 312 or the second ring 314 of the grip 330 extending a distance from the grip 330 and resonator 334, spaced away from the grip 330 in a direction substantially perpendicular to the direction in which the fingers of a user's hand 100 may be inserted through the grip 330. In an embodiment, the actuator 332 may be spaced approximately 1 mm to approximately 2 mm from the resonator 334. In another embodiment, the actuator 332 may be spaced approximately 0.5 mm to approximately 5 mm from the resonator 334. In an embodiment, the actuator 332 is on the grip 330 with the actuator 332 extending in a direction substantially parallel to the extension of the first shaft 324 and substantially perpendicular to the direction in which the fingers of a user's hand 100 may be inserted through the grip 330. In the embodiment shown in FIGS. 12-15, the actuator 332 comprises the spring 320 between the hammer or striking implement 322 and the coupling element 326 such that when assembled, the hammer or striking implement 322 is configured extend out from the bell device 310 such that it can be activated by a user during use. In this embodiment, the hammer or striking implement 322 of the actuator 332 may extend from the first ring 312 or the second ring 314 of the grip 330 such that the actuator 332 may be moved and caused to vibrate and strike the resonator 334 with a finger (i.e., the thumb) of a user's hand 100, activating the bell device 310 to sound or ring. The first shaft 324 and the second shaft 318 of the bell device 310, according to this embodiment, may be sized and shaped as described above with regards to the embodiments shown in FIGS. 1-9. In an embodiment, the actuator 332 is coupled to the grip 30 at a side of the grip 30 (as shown in the FIGS.) via an opening in the grip 330 configured to couple with a threaded insert. In this embodiment, the spring 320 of the actuator 332 may comprise threads or a screw-pattern configured to couple with the opening in the grip 330 at one end, and with the hammer or striking implement 322 at the opposite end (as described above with reference to FIGS. 1-6). In this embodiment, the at least 5 mm (3/16 inch) of the spring 320 is coupled or locked at each end into the opening in the grip 330 and at the hammer or striking implement 322 at the opposite end, respectively.

Figure 19:
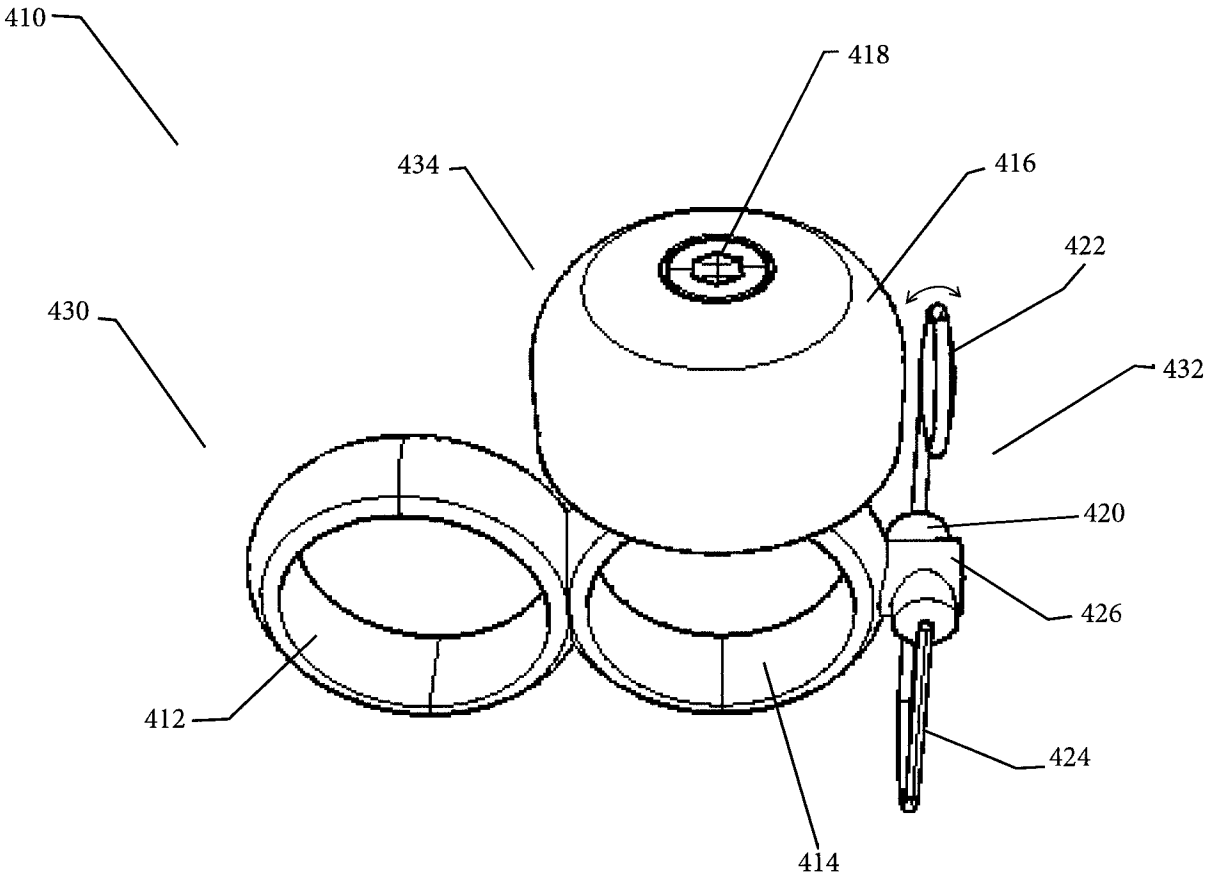
FIG. 19 is a perspective view showing a grip of the handheld sounding device of FIG. 16 configured for a left-handed user.
Figure 20:
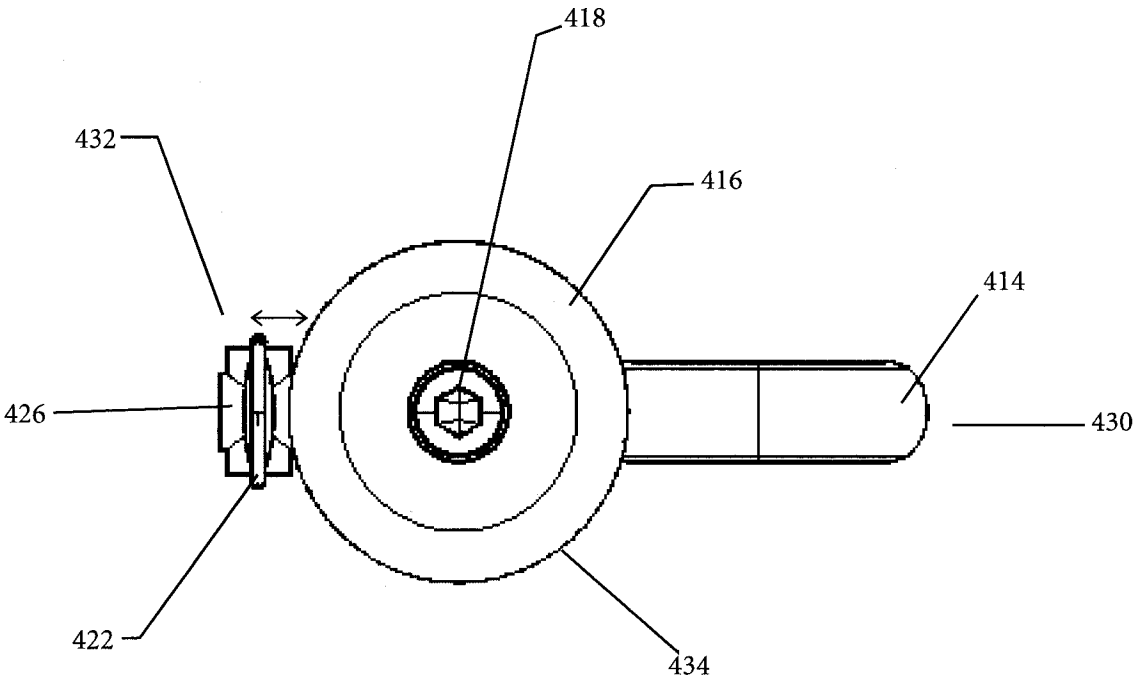
FIG. 20 is a top view of the handheld sounding device of FIG. 16.

With reference to FIGS. 16-20, a handheld sounding device according to another embodiment of the present invention is shown. The handheld bell device 410, according to this embodiment, includes a grip or grip component 430 (similar to that shown in FIGS. 12-15), an actuator or actuator component 432 (similar to that shown in FIG. 11), and a resonator or resonator component 434 (similar to that shown in FIGS. 12-15). The handheld bell device 410, according to this embodiment, is substantially similar to the handheld bell device 310 shown and described in the embodiments in FIGS. 12-15, and repeated descriptions are omitted. Thus, the grip 430 further comprises two rings, a first ring 412 and a second ring 414, each configured for insertion of a finger of the user's hand 100. The shaft 424, in this embodiment, may be coupled to the first ring 412 (as shown in FIG. 16, for example) or the second ring 414 (as shown in FIG. 19, for example). The resonator 434, according to this embodiment, further comprises a second shaft 418 and a hollow, dome-shaped acoustic resonating component 416.

With continued reference to the embodiments shown in FIGS. 16-20, the actuator 432 of the bell device 410 may further comprise a striking implement or hammer 422, a spring 420, a spring support 424, and a coupling element or third shaft 426, substantially similar to those described with regards to the embodiments shown in FIG. 11, above. The actuator 432, according to this embodiment, is substantially similar to that shown in FIG. 11, except the actuator 432 is coupled to the grip 430 at either the first ring 412 or the second ring 414 at a side of the grip 430, similar to the attachment of the actuator 332 described above, and as shown in the embodiments in FIGS. 12-15. The bell device 410, according to this embodiment, may be activated by striking the resonator 434 with the striking implement or hammer 422 of the actuator 432. The actuator 432 is configured to be moveable from an inert or at-rest position to a striking position configured to activate the bell device 410 at the spring 420. The spring 420, in this embodiment, may be configured to act as a joint or hinge to allow the hammer or striking implement 422 of the actuator 432 to be moved over a distance to sound the resonator 434 of the bell device 410. The actuator 432, according to this embodiment, may be sized and shaped as described above with regards to the embodiments shown in FIGS. 1-9 and 12-15.

The actuator 432, according to this embodiment, is coupled to the bell device 410 via the spring 420 and the coupling element or third shaft 426 at or around a midpoint of the actuator 432 at a midpoint of one of the rings 412 or 414 of the grip 430. The coupling element 426, in this embodiment, may be coupled to the grip 430 of the bell device 410 such that the coupling element 426 is coupled to either the first ring 412 or the second ring 414 of the grip 430 extending a distance from the grip 430 and resonator 434, spaced away from the grip 430 in a direction substantially perpendicular to the direction in which the fingers of a user's hand 100 may be inserted through the grip 430. In this embodiment, the actuator 432 is on the grip 430 with the actuator 432 extending in a direction substantially parallel to the extension of the wire support 424 and substantially perpendicular to the direction in which the fingers of a user's hand 100 may be inserted through the grip 430. The actuator 432, in these embodiments, is coupled to the grip 430 substantially similarly to the actuator 332 described above with reference to FIGS. 12-15, and repeated descriptions are omitted herein. In the embodiment shown in FIGS. 16-20, the actuator 432 comprises the wire support 424 around the spring 420 with the hammer or striking implement 422 at one end of the actuator 432 such that, when assembled, the hammer or striking implement 422 is configured to extend out from the bell device 410 to be activated by a user during use. In this embodiment, the hammer or striking implement 422 of the actuator 432 may extend from the first ring 412 or the second ring 414 of the grip 430 such that the actuator 432 may be moved and caused to vibrate and strike the resonator 434 with a finger (i.e., the thumb) of a user's hand 100, activating the bell device 410 to sound or ring. The first shaft 428 and the second shaft 418 of the bell device 410, according to this embodiment, may be sized and shaped as described above with reference to the embodiments shown in FIGS. 1-9 and FIGS. 12-15.

Figure 22:
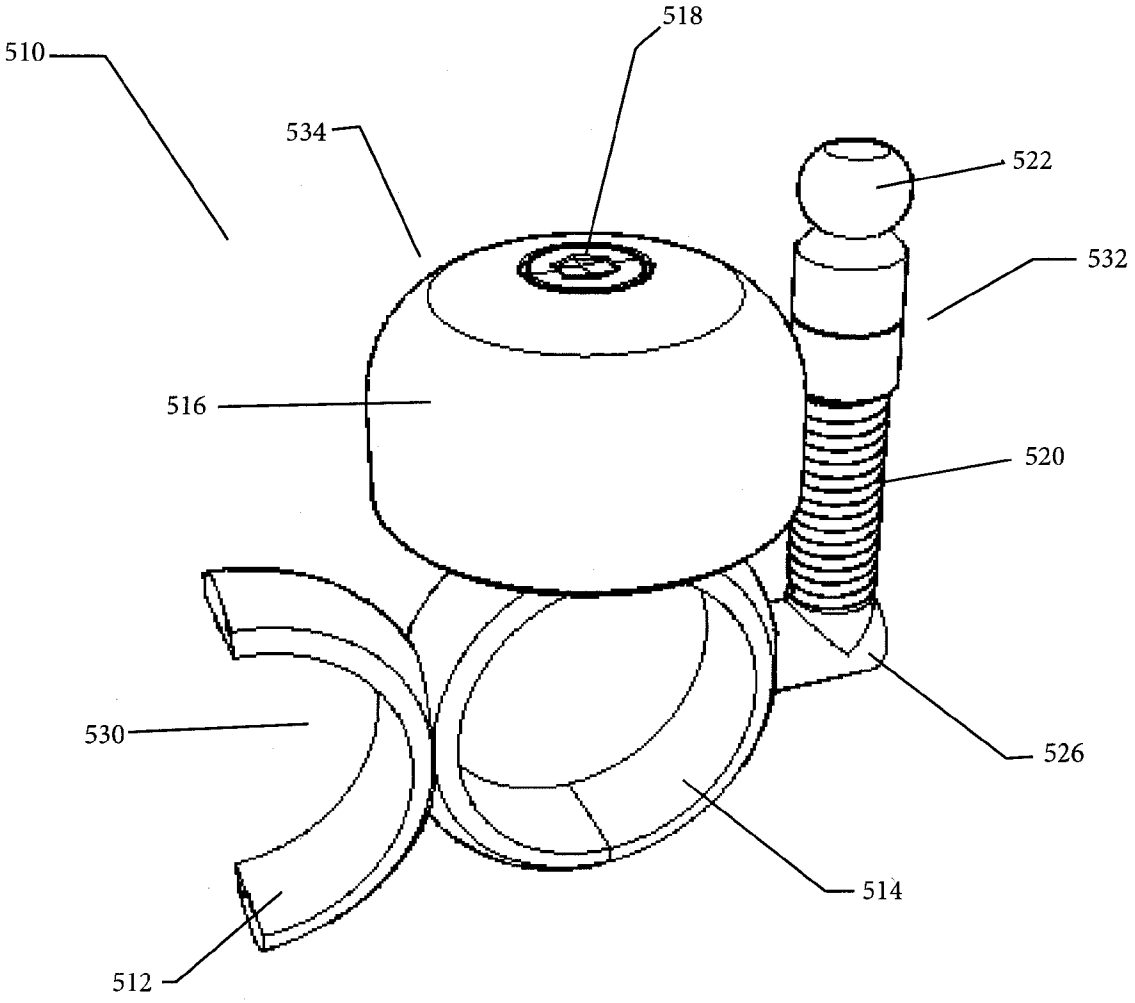
FIG. 22 is a perspective view showing a grip of the handheld sounding device of FIG. 21 configured for a left-handed user.
Figure 23:
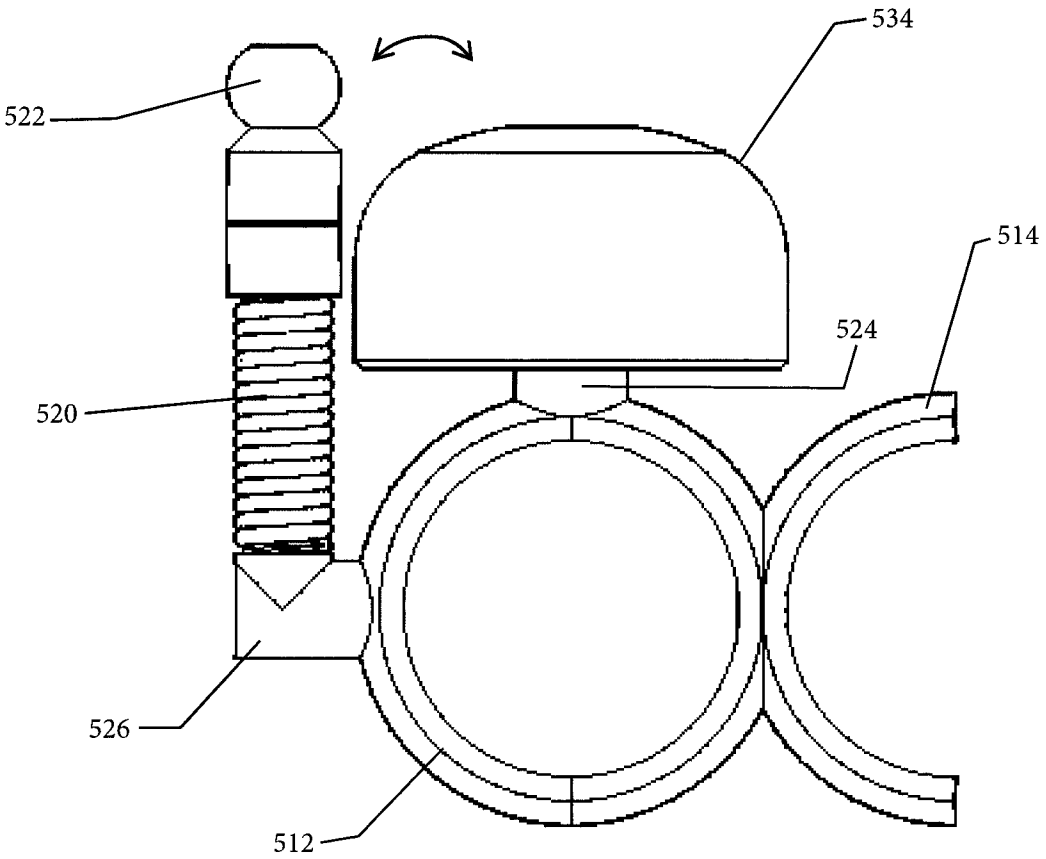
FIG. 23 is a side profile view of the handheld sounding device of FIG. 21.

With reference to FIGS. 21-23, a handheld sounding device according to another embodiment of the present invention is shown. The handheld bell device 510, according to this embodiment, includes a grip or grip component 530 (similar to that shown in FIGS. 12-15), an actuator or actuator component 532 (similar to that shown in FIG. 11), and a resonator or resonator component 534 (similar to that shown in FIGS. 12-15). The handheld bell device 510, according to this embodiment, is substantially similar to the handheld bell device 310 shown and described in the embodiments in FIGS. 12-15, and repeated descriptions are omitted. However, in this embodiment, the grip 530 comprises a first ring 512 and a portion of a second ring 514, the first ring 512 being configured for insertion of a finger of the user's hand 100, and the portion of the second ring 514 being configured to contact or be supported by a second (i.e., middle) finger of the user's hand 100. The bell device 510, in this embodiment, is configured to rest securely on and be supported by the fingers of the user's hand 100 such that the bell device 510 is prevented from rotating around the fingers or substantially moving around from its final position for use, once secured on the hand 100. The first shaft 524, in this embodiment, may be coupled to the first ring 512 (as shown in FIG. 21, for example). The resonator 534, according to this embodiment, further comprises a second shaft 518 and a hollow, dome-shaped acoustic resonating component 516. The actuator 532 of the bell device 510 may further comprise a striking implement or hammer 522, a spring 520, and a coupling element or third shaft 526, substantially similar to those described with regards to the embodiments shown in FIGS. 12-15, above. The components of the bell device 510, according to this embodiment, may be sized and shaped as described above with reference to the embodiments shown in FIGS. 1-9 and/or 12-20.

With further reference to FIGS. 1-6 (and similarly with reference to FIGS. 10-23, repeated descriptions for which are omitted below) and with further reference to the components of the bell device 10 shown in FIGS. 7-9, a method of using the bell device 10 (and similarly for the bell device 110, 210, 310, 410, and 510), according to an embodiment of the present invention, includes the task of placing at least one finger (i.e., the forefinger or index finger or middle finger of the hand 100) through the grip 30 of the bell device 10. In the embodiment shown in FIGS. 1-6, each of two fingers may be inserted through the grip 30 at each of the first ring 12 and the second ring 14 such that the bell device 10 may be securely and comfortably held on or in a user's single hand 100 (i.e., either the left or right hand 100). The bell device 10, according to this embodiment, is configured to rest or be held securely on or in a user's hand 100 through the grip 30 which is configured to prevent excessive or substantial rotation of the bell device 10 once in place. The grip 30, which includes both a first ring 12 and a second ring 14, in this embodiment, prevents substantial or excessive rotation of the bell device 10, once two fingers of the user's hand 100 have been inserted through the bell device 10 at least to the middle phalanx of the fingers, even where the user does not grasp or hold the bell device 10 tightly or securely. In other embodiments, as described above, the bell device 10 may rest or be supported on other portions of the fingers, including between the main knuckles and the proximal phalanx, or at the distal phalanx of the fingers of the hand 100.

Figure 3:
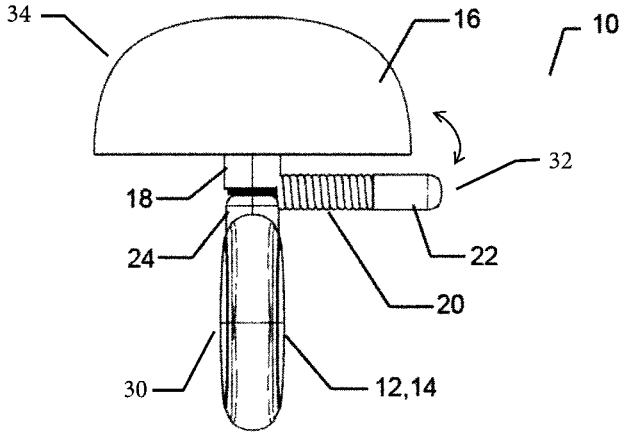
FIG. 3 is a side elevation view of the handheld sounding device of FIG. 1.
Figure 4:
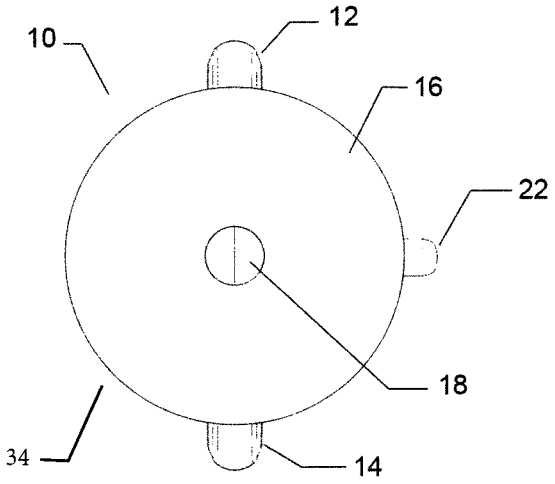
FIG. 4 is a top view of the handheld sounding device of FIG. 1.
Figure 5:
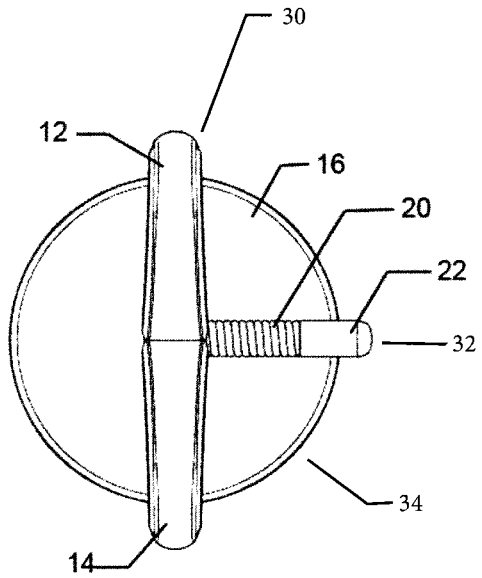
FIG. 5 is bottom view of the handheld sounding device of FIG. 1.
Figure 6:
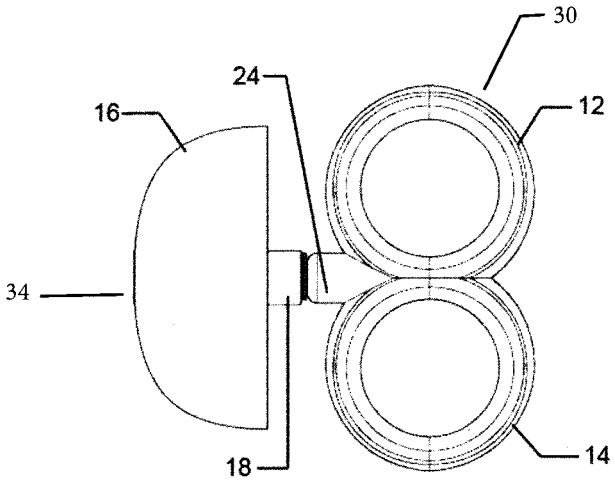
FIG. 6 is a side profile view of the handheld sounding device of FIG. 1.

The method of using the bell device 10, according to this embodiment of the present invention, further includes the task of using a finger of the hand 100 not coupled through the grip 30 (i.e., the thumb) to activate the actuator 32 of the bell device 10 at the hammer or striking implement 22 (as shown in FIG. 3). The actuator 32, according to this embodiment, is configured to move or bend at the spring 20 such that the hammer or striking implement 22 of the actuator 32 is moved from a first position at-rest and spaced from the resonator 34 to a second position contacting or striking the resonator 34 to activate or sound the bell device 10. In an embodiment, the actuator 32 is configured to move or bend approximately 90 degrees back at the spring 20 such that the hammer or striking implement 22 of the actuator 32 is moved from a first position at-rest and spaced approximately 1 mm to approximately 2 mm from the resonator 34 to a second position an additional 90 degrees further away from the resonator 34, and then released to a third position contacting or striking the resonator 34 to activate or sound the bell device 10. The spring 20 in these embodiments is configured to allow for a louder and/or more forceful striking of the actuator 32 against the resonator 34 using increased force at the finger (i.e., at the thumb), for example, by pulling the actuator 32 further back before releasing it to strike against the resonator 34. In this embodiment, the task of activating the actuator 32 includes pulling the actuator 32 of the bell device 10 back by accessing the hammer or striking implement 22 of the actuator 32 with a free finger of the hand 100, such as the thumb, and pulling back at the hammer or striking implement 22 to an ergonomic and/or allowable distance away from the resonator 34. The task, according to this embodiment, further includes releasing the hammer or striking implement 22 of the actuator 32, allowing the spring 20 to release and move the actuator 32 past its original position to strike the resonator 34. The striking of the actuator 32 against the resonator 34, according to these embodiments, results in activation of the bell device 310, sounding an alarm, tone, or bell. In these embodiments, the further back the actuator 32 is pulled (to an extent the spring 20 is not over-exhausted) prior to release, the louder and/or stronger the sound that may be created by the bell device 10 in operation. Similarly, the less the actuator 32 is pulled prior to release (to an extent), the softer the sound that may be created by the bell device 10 in operation. Activating the actuator 32, according to the embodiment shown in FIGS. 1-6, includes using the thumb to pull the actuator 32 in a downward direction from between the forefinger or index finger and middle finger, prior to release. Activating the actuator 332, according to the embodiment shown in FIGS. 12-15, for example (and similarly for FIGS. 16-23), includes using the thumb to pull the actuator 32 in a backward direction away from the resonator 334 from between the thumb and the forefinger, prior to release.

The bell device 10, according to other embodiments, may include other features coupled with the grip 30, actuator 32, and/or resonator 34 of embodiments of the present invention. For example, in embodiment, a flashlight or lighting device may be coupled to the grip 30 (130, 230, 330, 430, and/or 530) for use similar to that of the bell device 10. For example, in another embodiment, a pepper-spray, mace, or other protection/spray device may be coupled to the grip 30 (130, 230, 330, 430, and/or 530) for use similar to that of the bell device 10. In other embodiments, the handheld bell device 10 may be configured for training animals, for example, dogs, with the resonator 34 and actuator 32 being adjusted and configured to click or sound rather than ring when activated. Additional embodiments may include a clicker, censor, or transponder-type device coupled to the grip 30 (130, 230, 330, 430, and/or 530) for use similar to that of the bell device 10. In other embodiments, the handheld bell device 10 may be configured for use by certain types of users, for example, users that may identify as being visually impaired, to signal or alert others of their presence during approaches in busy areas, etc. The handheld bell device 10 may also be configured for use during hiking and in place of a bear bell, allowing the user to constantly engage the resonator 34 to alert and ward off bears or other animals from approaching, etc.

While this invention has been described in detail with particular references to embodiments, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "vertical," "horizontal," "top," "bottom," "middle," "under," "on," and similar have been used herein to describe a spatial relationship of one element to another, it should be understood that these terms are intended to encompass different orientations of the various elements and components of the invention in addition to the orientation depicted in the figures. Additionally, as used herein, the term "substantially," "about," "approximately," and similar are used as terms of approximation and not as terms of degree, and are intended to account for the inherent deviations in measured or calculated values that would be recognized by those of ordinary skill in the art.

Moreover, the tasks described above may be performed in the order described or in any other suitable sequence. Instead, for each embodiment, one or more of the tasks described above may be absent and/or additional tasks may be performed. Furthermore, as used herein, when a component is referred to as being "on" another component, it can be directly or indirectly on the other component, meaning, for example, intervening layers, regions, or components may also be present. Moreover, when a component is referred to as being "coupled" to another component, it can be directly attached or connected to the other component, or other intervening components may also be present therebetween.

While the invention has been described in connection with certain embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A sounding device, comprising:

a grip;

an actuator adjacent the grip; and a resonator adjacent the actuator, wherein the grip is configured to be worn on one hand of a user, wherein the grip comprises at least one ring configured to be worn on one finger of the one hand of the user, wherein the at least one ring of the grip comprises at least one first ring and a second ring portion adjacent to the at least one first ring, the second ring portion being configured to be supported by a second finger of the one hand of the user, wherein the actuator is configured to make contact with the resonator, and the resonator is configured to make a sound when contacted by the actuator, wherein the actuator and the resonator are coupled to the grip of the sounding device at the at least one first ring, wherein the resonator is centered on the at least one first ring configured to be worn on a forefinger of a user, and wherein the actuator extends up from a side of the at least one first ring at a location approximately 90 degrees from where the resonator is coupled to the at least one first ring, the actuator being configured to be accessible by a thumb of the user's hand for activating the sounding device.

2. The sounding device of claim 1, wherein the second ring portion comprises a full second ring, and wherein the at least one first ring of the grip is configured to be worn on the forefinger and the full second ring is configured to be worn on the middle finger of the one hand of the user.

3. The sounding device of claim 1, further comprising a shaft, the shaft being coupled at a bottom of the shaft to the grip and extending up from the grip in a direction substantially perpendicular to a direction in which the first and second fingers of the one hand of the user are configured to support the grip;

wherein the actuator is coupled to the shaft in a direction substantially perpendicular to the shaft, and wherein the resonator is coupled to the shaft at a top of the shaft, such that the grip is coupled to the shaft at a bottom of the shaft, the actuator is between the grip and the resonator, and the resonator is at a top of the shaft.

4. The sounding device of claim 1, further comprising a shaft, the shaft being coupled at a bottom of the shaft to the grip and extending up from the grip in a direction substantially perpendicular to a direction in which the first and second fingers of the one hand of the user are configured to support the grip;

wherein the actuator is coupled to the shaft in a direction substantially parallel to the shaft, and wherein the resonator is coupled to the shaft at a top of the shaft, such that the grip is coupled to the shaft at a bottom of the shaft, the actuator extends out from between the grip and the resonator, and the resonator is at a top of the shaft.

5. The sounding device of claim 1, wherein the actuator further comprises:

a striking element;

a spring coupled to the striking element adjacent a midpoint of the actuator; and a coupling element at a bottom of the actuator configured to couple the actuator to the sounding device, wherein the striking element is at a top of the actuator and is configured to make contact with the resonator when activated, and wherein the spring is configured to hinge to allow the striking element to move a distance from its resting position to a position contacting the resonator when activated.

6. The sounding device of claim 5, wherein the actuator is configured to make contact with the resonator from a side or top of the resonator.

7. The sounding device of claim 5, wherein the actuator is configured to make contact with the resonator from a bottom and center of the resonator.

8. A sounding device, comprising:

a grip;

an actuator adjacent the grip; and a resonator adjacent the actuator, wherein the grip is configured to be worn on one hand of a user, wherein the grip comprises at least one ring configured to be worn on one finger of the one hand of the user, wherein the at least one ring of the grip comprises at least one first ring and a second ring adjacent to the at least one first ring, the second ring being configured to be supported by a second finger of the one hand of the user, wherein the actuator is configured to make contact with the resonator, and the resonator is configured to make a sound when contacted by the actuator, and wherein the second ring comprises a portion of a third ring, and wherein the at least one first ring and the second ring of the grip are configured to be worn on the forefinger and the middle finger of the one hand of the user, and wherein the portion of the third ring is configured to be supported on a ring finger of the user's hand.

9. A sounding device, comprising:

drip;

an actuator adjacent the grip; and a resonator adjacent the actuator, wherein the grip is configured to be worn on one hand of a user, wherein the actuator is configured to make contact with the resonator, and the resonator is configured to make a sound when contacted by the actuator, wherein the actuator comprises:

a striking element;

a spring coupled to the striking element adjacent a midpoint of the actuator; and a coupling element at a bottom of the actuator configured to couple the actuator to the sounding device, a wire support, the wire support extending from the coupling element downward in a u-shape past the grip and back up toward the resonator with the striking element at a top end of the u-shape and the spring coupled to the wire support and the coupling element near a midpoint of the actuator, wherein the striking element is at a top of the actuator and is configured to make contact with the resonator when activated, and wherein the spring is configured to hinge to allow the striking element to move a distance from its resting position to a position contacting the resonator when activated.

10. A sounding device, comprising:

a grip comprising a first ring and a second ring coupled together;

an actuator adjacent the grip, the actuator comprising a striking element, a spring, and a coupling element, wherein the coupling element is coupled to the first ring of the grip, and the spring is between the striking element and the coupling element; and a resonator adjacent the grip, the resonator having a diameter equal to an outer diameter of the first ring and being coupled to the first ring at a center of the resonator and the first ring, wherein the grip is configured to be worn on one hand of a user with the first ring on an index finger and the second ring on a middle finger of the one hand, wherein the grip further comprises a removable insert configured to adjust the size of the grip to fit the one hand of the user, and wherein the actuator is configured to make contact with the resonator with the striking element, and the resonator is configured to make a sound when contacted by the striking element of the actuator.

11. The sounding device of claim 10, wherein the actuator is configured to be bent at the spring from a first position spaced from the resonator, back to a second position a distance further spaced from the resonator when pulled in such a direction, and to spring forward and make contact with the resonator at a third position when released from the second position.

* * * * *